US010072914B2

(12) United States Patent
Flint et al.

(10) Patent No.: US 10,072,914 B2
(45) **Date of Patent: *Sep. 11, 2018**

(54) FRAGMENTING PROJECTILE

(71) Applicant: G2 Research Inc., Winder, GA (US)

(72) Inventors: Michael Scott Flint, Winder, GA (US); Paul Gombar, Jr., Winder, GA (US)

(73) Assignee: G2 Research Inc., Hoschton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/412,260

(22) Filed: Jan. 23, 2017

(65) Prior Publication Data

US 2018/0112962 A1 Apr. 26, 2018

Related U.S. Application Data

(63) Continuation of application No. 15/133,613, filed on Apr. 20, 2016, now Pat. No. 9,551,555, which is a continuation of application No. 14/269,791, filed on May 5, 2014, now Pat. No. 9,354,027.

(60) Provisional application No. 61/895,247, filed on Oct. 24, 2013.

(51) Int. Cl.

| | |
|---|---|
| ***F42B 10/00*** | (2006.01) |
| ***F42B 12/00*** | (2006.01) |
| ***F42B 30/00*** | (2006.01) |
| ***F42B 12/74*** | (2006.01) |
| ***F42B 12/36*** | (2006.01) |
| ***F42B 12/34*** | (2006.01) |

(52) U.S. Cl.
CPC ..... *F42B 12/74* (2013.01); *F42B 12/34* (2013.01); *F42B 12/367* (2013.01)

(58) Field of Classification Search
CPC ..... F42B 12/34; F42B 12/74; F42B 12/367
USPC ..... 102/506–510
See application file for complete search history.

(56) References Cited

U.S. PATENT DOCUMENTS

| | | | | |
|---|---|---|---|---|
| 3,003,420 | A * | 10/1961 | Nosler | F42B 12/34 102/508 |
| 4,048,922 | A | 9/1977 | Buljovcic | |
| 4,128,059 | A | 12/1978 | Black | |
| 4,550,662 | A | 11/1985 | Burczynski | |
| 4,587,905 | A | 5/1986 | Maki | |
| 4,610,061 | A | 9/1986 | Halverson | |
| 4,777,882 | A | 10/1988 | Dieval | |
| 4,856,160 | A | 8/1989 | Habbe et al. | |
| 5,079,814 | A | 1/1992 | Moore et al. | |

(Continued)

FOREIGN PATENT DOCUMENTS

| | | |
|---|---|---|
| JP | S5712300 | 1/1982 |
| WO | WO 2014080136 | 5/2014 |

OTHER PUBLICATIONS

International Search Report and Written Opinion dated Feb. 6, 2015 in International Application No. PCT/US2014/062138.

(Continued)

*Primary Examiner* — Samir Abdosh
(74) *Attorney, Agent, or Firm* — Hartman & Citrin LLC

(57) ABSTRACT

Embodiments of a projectile are disclosed herein. According to various embodiments, a projectile includes a substantially solid core of a material, and two or more petals attached to the core. The two or more petals can be formed from the same material used to form the core and can include a trocar tip. A cavity can be bound by the core and inner surfaces of the plurality of petals.

20 Claims, 15 Drawing Sheets

(56) References Cited

U.S. PATENT DOCUMENTS

| | | | | | |
|---|---|---|---|---|---|
| 5,101,732 | A * | 4/1992 | Schluckebier | F42B 12/78 | 102/509 |
| 5,131,123 | A * | 7/1992 | Brooks | B21K 1/025 | 86/54 |
| 5,208,424 | A * | 5/1993 | Schluckebier | F42B 12/34 | 102/509 |
| 5,259,320 | A * | 11/1993 | Brooks | B21K 1/025 | 102/501 |
| 5,263,418 | A | 11/1993 | Dippold et al. | | |
| 5,357,866 | A * | 10/1994 | Schluckebier | F42B 12/34 | 102/509 |
| 5,528,990 | A | 6/1996 | Corzine et al. | | |
| 5,943,749 | A * | 8/1999 | Swank | B21K 1/025 | 102/509 |
| 6,148,731 | A | 11/2000 | Winter | | |
| 6,305,292 | B1 | 10/2001 | Burczynski | | |
| 6,484,642 | B1 | 11/2002 | Kuhns et al. | | |
| 6,694,888 | B2 | 2/2004 | Jopson et al. | | |
| 6,776,101 | B1 | 8/2004 | Pickard | | |
| 6,805,057 | B2 | 10/2004 | Carr et al. | | |
| 6,845,717 | B1 | 1/2005 | Sauvestre | | |
| 6,935,243 | B2 * | 8/2005 | Dippold | F42B 12/34 | 102/508 |
| 7,162,942 | B2 | 1/2007 | Dippold | | |
| 7,743,708 | B1 | 6/2010 | Lawrence | | |
| 8,413,587 | B2 | 4/2013 | Emary | | |
| 8,578,856 | B2 | 11/2013 | Riess et al. | | |
| 8,646,389 | B2 | 2/2014 | Masinelli | | |
| 9,046,333 | B2 | 6/2015 | Masinelli | | |
| 9,200,878 | B2 | 12/2015 | Seecamp | | |
| 2003/0192425 | A1 | 10/2003 | Olin | | |
| 2008/0092768 | A1 | 4/2008 | Krstic | | |
| 2008/0314280 | A1 | 12/2008 | Martini Filho | | |
| 2010/0018430 | A1 * | 1/2010 | Masinelli | F42B 12/34 | 102/507 |
| 2012/0111220 | A1 * | 5/2012 | King | F42B 12/34 | 102/509 |
| 2013/0092041 | A1 | 4/2013 | Seecamp | | |

OTHER PUBLICATIONS

U.S. Office Action dated Nov. 6, 2015 in U.S. Appl. No. 14/269,791.

U.S. Notice of Allowance dated Mar. 28, 2016 in U.S. Appl. No. 14/269,791.

U.S. Notice of Allowance dated Sep. 8, 2016 in U.S. Appl. No. 15/133,613.

Bigslug, "Diemakers—Swaging a Hexagonal (Whitworth) Bullet?," Cast Boolits, May 27, 2012, www.castboolits.gunloads.com.

Grayrock, "PT 145 Owners, Post Here," TaurusArmed.net, Jul. 19, 2014.

"Rainier Peak Performance Delivers Accuracy, Value, Better Terminal Performance and Less Lead Vapor," Rainier Peak Performance, www.rainierballistics.com, Feb. 19, 2015, Rainier Ballistics, LLC.

"Prime 9mm Luger Hexagon 124GR Match +," Prime Ammunition, retrieved at http://www.primeammo.com/9mm-luger-hexagon-124gr.html on Apr. 10, 2016.

"Geco Handgun Ammunition," Geco, retrieved at http://geco-munition.de/en/products/ammo-for-pistols-and-revolver.html on Apr. 10, 2016.

Supplementary European Search Report and European Search Opinion issued by the European Patent Office in European Patent Application No. 14855305.0 dated May 31, 2017.

International Search Report and Written Opinion dated Feb. 1, 2018 in International Application No. PCT/US2017/056031.

* cited by examiner

FRAGMENTING PROJECTILE

CROSS-REFERENCE TO RELATED APPLICATIONS

This patent application is a continuation of and claims priority to U.S. patent application Ser. No. 15/133,613, entitled "Projectile," filed Apr. 20, 2016, now U.S. Pat. No. 9,551,555, which is incorporated herein by reference in its entirety; and which is a continuation of and claims priority to U.S. patent application Ser. No. 14/269,791, entitled "Fragmenting Projectile," filed May 5, 2014, now U.S. Pat. No. 9,354,027, which is incorporated herein by reference in its entirety; and which claims priority to U.S. Provisional Patent Application No. 61/895,247, filed Oct. 24, 2013, entitled "Predictable Fragmentation of Trocar-Pointed Projectile Petals," which is incorporated herein by reference in its entirety.

TECHNICAL FIELD

This disclosure relates generally to firearms and ballistic technologies. More particularly, the disclosure made herein relates to a fragmenting projectile.

BACKGROUND

Unless otherwise indicated herein, the materials described in this section are not prior art to the claims in this application and are not admitted to be prior art by inclusion in this section.

Firearms are believed to have first been invented around the thirteenth or fourteenth centuries. At that time, "firearms" consisted of bamboo rods used to guide shrapnel or other projectiles using the force of combusting gunpowder. Over the years, firearms have evolved tremendously, as have the projectiles fired from firearms.

Many early firearms relied on various forms of shrapnel for projectiles. With the evolution of firearms, bullets and other projectiles similarly have evolved. With the evolution of the musket and similar firearms, spherical lead balls were used for projectiles as the soft lead could be pushed into the barrel easily and provided a relatively effective projectile. With the advent of modern firearms, particularly in the early part of the nineteenth century, bullets evolved into pointed or conical projectiles. For example, Norton's bullet, named for John Norton of the British Army, was among the earliest pointed projectiles, the precursor of modern bullets and other projectiles.

In the late nineteenth century, copper jacketing processes were introduced to firearm projectiles. Copper jacketing was used to protect the projectile from melting and/or otherwise deforming in the barrel of the firearm due to pressures and heat in the barrel. Thus, copper jacketing allowed bullets to evolve from flying chunks of lead with limited accuracy, speed, and effectiveness into carefully aimed high speed projectiles that maintained their shape in the barrel and during flight.

In the twentieth century, ballistics took many leaps. In the twentieth century, for example, the spitzer bullet shape was introduced, which is essentially the shape of the modern rifle bullet. Similarly, boat tail bullets were introduced, which further enhanced the accuracy of bullets, as well other shapes and modifications introduced during this time period. During the twentieth century, evolution of overall bullet shape essentially was completed. Thus, bullet makers began increasing the lethality and/or damaging effect of bullets, particularly in the last half of the twentieth century. In particular, the hollow point was introduced to bullets to increase and/or control the expansion (sometimes referred to as the "mushrooming" effect) of the bullet when penetrating a target. The hollow point evolved considerably during the last fifty years or so to provide many types of self-defense and hunting ammunition.

One tradeoff often encountered by bullet makers is that penetration of bullets often must be sacrificed for expansion of the bullet in the target. In some targets, the lack of penetration can limit the effectiveness of the bullet. For example, the bullet may expand to a large size, but not contact any vital organs of a target if the bullet does not penetrate into a body cavity of the target. Thus, while the bullet may damage the cutaneous, subcutaneous, and/or even some internal organs of the target, the bullet may lack the effectiveness to neutralize the target due to a lack of penetration.

Similarly, if penetration is prioritized over expansion, the effectiveness of the bullet can be diminished. In particular, a bullet may penetrate a target or even pass through the target without contacting any vital organs and/or without causing sufficient damage to the vital organs to incapacitate the target. Of course, penetration through the target can create or increase a risk of collateral damage to people or objects in the vicinity of the target. For example, a small caliber bullet may pass through a target and pierce organs without neutralizing the target. In the realm of self-defense ammunition, the goal generally is to provide maximum expansion and maximum penetration to attempt to ensure that a threat is neutralized as quickly as possible. Another goal of self-defense ammunition is to expend as much of the projectiles energy as possible within the target.

SUMMARY

Concepts and technologies are disclosed herein for a fragmenting projectile. In some embodiments, the fragmenting projectile is designed to reduce the tradeoff between penetration and expansion. In particular, embodiments of the concepts and technologies described herein provide a fragmenting projectile that expands in a predictable manner and still penetrates targets effectively. In particular, various embodiments of the concepts and technologies described herein are directed to trocar-pointed projectiles (hereinafter "fragmenting projectile") that can include a base or core ("core") and two or more trocar-pointed petals that are formed such that the petals are attached to the core.

The petals are designed to provide predictable and controlled behavior as the fragmented projectile passes through various media. The behavior can be predicted and controlled based upon various parameters such as petal thickness, projectile and petal geometry, material selection, projectile velocity, and/or other parameters. In various embodiments, the fragmenting projectile is designed such that the projectile passes through hard media such as walls, glass, clothing, or the like, and generally only fragments upon contacting a soft media such as ballistics gel, animal or human flesh or tissue, liquids, or the like. In particular, the fragmenting projectile can be designed such that the petals remain intact and can provide a sawing action (e.g., can behave like a hole saw blade) when engaging a hard medium. Thus, the fragmenting projectile can pass through a wall or other medium without expanding, thus maintaining its shape and form until entering a soft medium or other target.

Upon encountering a medium that triggers expansion of the fragmenting projectile, the petals can break off the core and "swim" through the target. In some embodiments, the petals are first forced inward toward a center of the bullet, and then forced outward by the liquid or other medium entering a cavity formed by the petals. These back-and-forth forces can deform the petals, giving the petals an arc shape that encourages the petals to expand away from the center of the core. The expansion of the petals outward can create an opening in the medium, thereby increasing penetration of the core into the target. Similarly, the petals can create additional wound channels in the target, thereby increasing the damage caused by the fragmenting projectile within the target and increasing the effectiveness of the fragmenting projectile.

According to one aspect of the concepts and technologies described herein, a fragmenting projectile is disclosed. The fragmenting projectile can include a substantially solid core of a material and two or more petals attached to the core. The two or more metals can be formed from the material used to form the petals, and each of the two or more petals can include a trocar tip. The fragmenting projectile also can include a cavity, which can be bound by the core and inner surfaces of the two or more petals.

In some embodiments, the fragmenting projectile does not fragment when engaging a first medium and the fragmenting projectile fragments when engaging a second medium. The first medium can include wood, and the second medium can include animal tissue or human tissue. In some embodiments, the two or more petals include eight petals. The fragmenting projectile also can include two or more channels that define the two or more petals.

In some embodiments, the fragmenting projectile also can include a groove formed on the fragmenting projectile. The fragmenting projectile can be formed from a copper alloy. The copper alloy can have a tensile strength in a range of about 36 kilopounds per square inch to about 41 kilopounds per square inch. The copper alloy can include a tellurium-copper alloy having about 0.5% tellurium, about 99.5% copper, and a tensile strength of about 37.5 kilopounds per square inch.

In some embodiments, the fragmenting projectile can include break-off notches to encourage failure of the material at the break-off notches. In some embodiments, the fragmenting projectile can include a dimple formed in the material to encourage failure of the material at the dimple. The dimple can include a perforation that passes through the material to allow pressure in the cavity to escape through the two or more petals. In some embodiments, the core can include a point. In some embodiments, the fragmenting projectile can be formed from a single piece of material.

According to another aspect of the concepts and technologies described herein, a fragmenting projectile is disclosed. The fragmenting projectile can include a core of a material and two or more petals attached to the core. The two or more petals can be formed from the material used to form the core. The two or more petals can include a trocar tip. The fragmenting projectile also can include a cavity, which can be bound by the core and inner surfaces of the two or more petals.

In some embodiments, the core includes about one third of a total mass of the fragmenting projectile, and the two or more petals include about two thirds of the total mass of the fragmenting projectile. In some embodiments, the two or more petals include eight petals. In some embodiments, the fragmenting projectile can be formed from a copper alloy, and the copper alloy can have a tensile strength within a range of about 36 kilopounds per square inch to about 41 kilopounds per square inch. In some embodiments, the fragmenting projectile further can include two grooves formed on the fragmenting projectile.

According to yet another aspect of the concepts and technologies described herein, a fragmenting projectile is disclosed. The fragmenting projectile can include a core of a material, and two or more petals attached to the core and formed from the material. Each of the two or more petals can include a trocar tip, an outer surface, and an inner surface. The fragmenting projectile also can include a cavity bound by the core and the two or more petals, and the cavity can be defined by inner surfaces of the two or more petals.

In some embodiments, the two or more petals can include eight petals, the fragmenting projectile can be formed from a copper alloy, and the copper alloy can have has a tensile strength within a range of about 36 kilopounds per square inch to about 41 kilopounds per square inch. In some embodiments, the fragmenting projectile further can include two grooves formed on outer surfaces of the petals.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
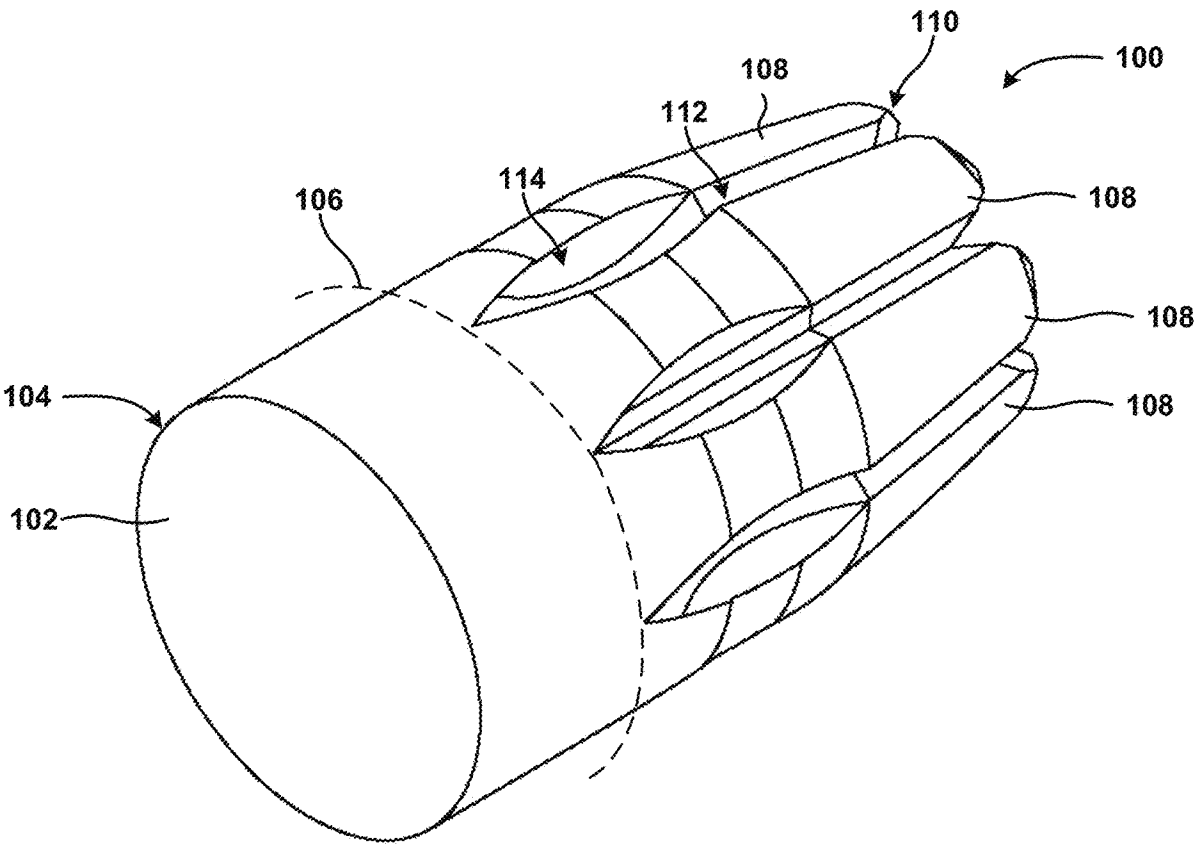
FIG. 1 is a line drawing showing a perspective view of a fragmenting projectile, according to an illustrative embodiment of the concepts and technologies described herein.

The following detailed description is directed to a fragmenting projectile. In some embodiments, a fragmenting projectile can include a base or core ("core") and two or more trocar-pointed petals that can be formed such that the petals are attached to the core. Various numbers of petals are contemplated and are possible. In particular, a fragmenting projectile as disclosed herein can include two or more petals, though some embodiments of the fragmenting projectile include eight or more petals, nine or more petals, or the like. The petals can be designed to provide predictable and controlled behavior as the fragmented projectile passes through various media.

The behavior of the fragmenting projectile can be predicted and controlled based upon various parameters such as petal thickness, projectile and petal geometry, cavity diameter and/or depth, shape of the core, material selection, presence or absence of grooves or dimples, projectile velocity, and/or other parameters. Thus, a first embodiment of the fragmenting projectile such as a 45 ACP bullet may not merely be a scaled version of a second embodiment of the fragmenting projectile such as a 9 mm bullet. This will be more clearly understood with reference to the FIGURES and description below.

In various embodiments of the concepts and technologies described herein, the fragmenting projectile can be designed such that the projectile behaves differently in varied media. For example, some embodiments of the fragmenting projectile may pass through hard media such as walls, glass, metal, clothing, or the like without expanding or fragmenting. The fragmenting projectile also may fragment upon contacting a soft media such as ballistics gel, animal flesh or tissue, human flesh or tissue, liquids, or the like. In particular, the fragmenting projectile can be designed such that the petals remain intact and provide a sawing action (e.g., can behave like a hole saw blade) when engaging a hard medium. Thus, the fragmenting projectile can pass through a wall or other medium without expanding, thus maintaining its shape and form until entering a soft medium or other target.

Upon encountering a medium that triggers expansion of the fragmenting projectile, for example a soft medium such as liquid, flesh, tissue, or the like, the fragmenting projectile can fragment. During fragmentation, the petals can break off the core and expand outward. In some embodiments, the petals "swim" through the target along a predictable path. In some embodiments, the path is substantially linear, while in some other embodiments, the path is substantially arc-shaped.

In some embodiments of the concepts and technologies described herein, fragmentation can occur over several steps. In a first step, the petals can be forced inward toward a center of the bullet due to external forces placed on the outside of the bullet. During a second step, the cavity formed by the petals can fill with the medium and the medium can force the petals outward. The back-and-forth forces can deform the petals, giving the petals an arc shape that encourages the petals to expand away from the center of the core along an arc-shaped path. The core can continue along an initial path without being substantially affected by the fragmentation of the petals.

In some embodiments, the expansion of the petals outward can create an opening in the medium. This, in turn, can increase penetration of the core into the target by reducing resistance near the entry and fragmentation point within the medium. Thus, the core can penetrate the target while the petals can expand outward effectively providing expansion of the bullet. The petals can create wound channels in the target. Thus, embodiments of the concepts and technologies described herein can increase the damage caused by the fragmenting projectile within the target and can increase the effectiveness of the fragmenting projectile. These and other aspects of the concepts and technologies described herein will be described herein in further detail.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of fragmenting projectiles will be presented.

Turning to FIG. 1, aspects of a fragmenting projectile according to various embodiments of the concepts and technologies described herein will be described in detail. In particular, FIG. 1 illustrates a fragmenting projectile 100 according to one example embodiment of the concepts and technologies described herein. As shown in FIG. 1, the fragmenting projectile can include a base or core (hereinafter referred to as a "core") 102. In some embodiments, the core 102 is defined by a substantially smooth and/or continuous solid cylindrical portion of material. Thus, the core 102 can be defined as the material between a base 104 of the fragmenting projectile 100 and a level 106 of the fragmenting projectile 100 at which structures associated with one or more petals 108 of the fragmenting projectile 100 begin.

As noted above, the FIGURES are not necessarily to scale. As such, it should be understood that the level 106 at which the structures associated with the petals 108 begin can be shifted away or toward the base 104 without departing from the scope of this disclosure. As such, the illustrated embodiment should be understood as being illustrative of one contemplated embodiment and therefore should not be construed as being limiting in any way. In particular, in some embodiments, the core 102 can contain about one third of the total mass of the fragmenting projectile 100, which can correspond to about one quarter of the total length of the fragmenting projectile 100.

Figure 17:
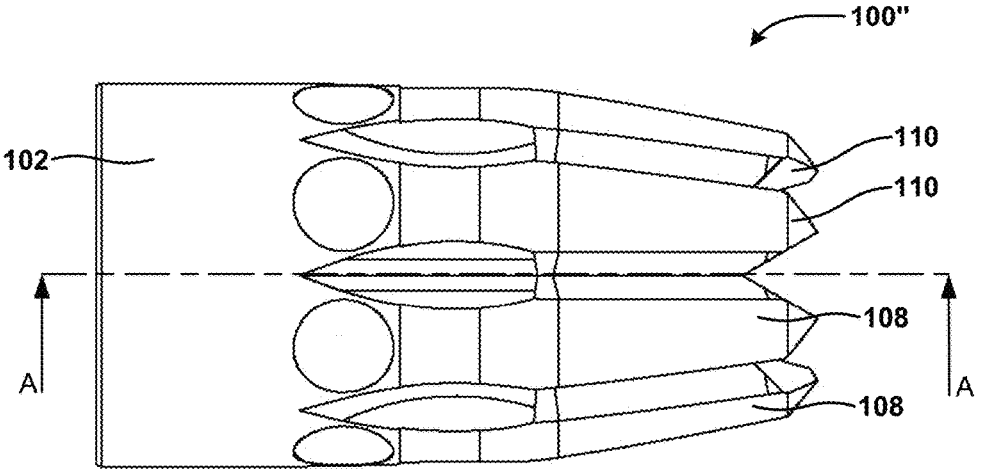
FIG. 17 is a line drawing showing a side elevation view of the fragmenting projectile, according to still another illustrative embodiment of the concepts and technologies described herein.
Figure 18:
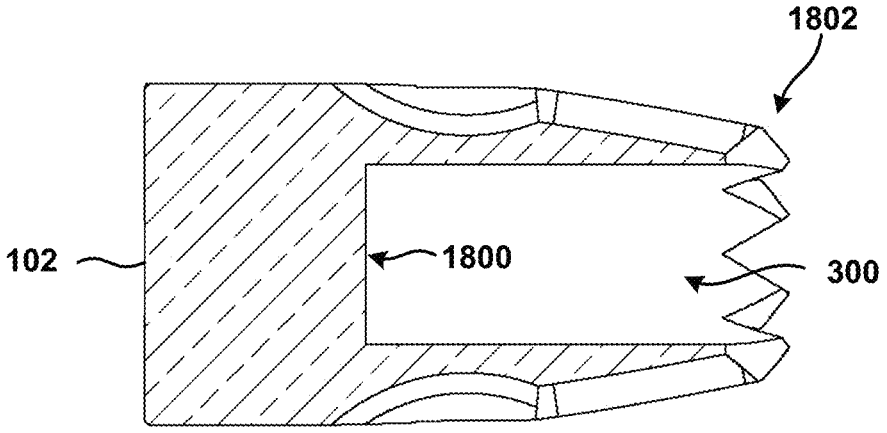
FIGS. 18-21 are line drawings showing cut-away views of the fragmenting projectiles, according to various embodiments of the concepts and technologies described herein.
Figure 19:
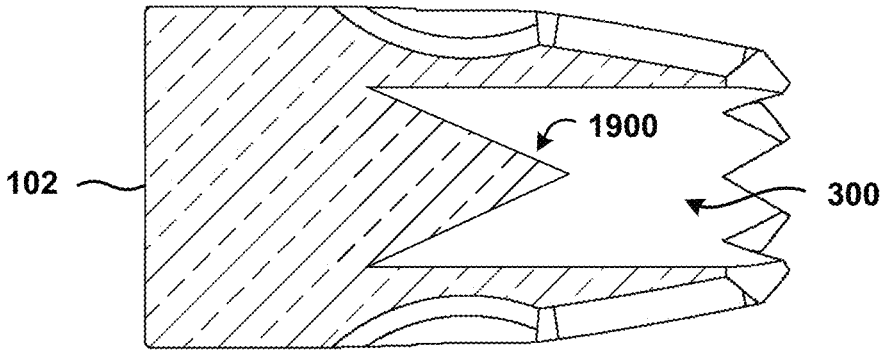

In some other embodiments, the core 102 can contain about one half of the total mass of the fragmenting projectile 100, which can correspond to about one quarter to one half of the total length of the fragmenting projectile 100 (examples are shown in FIGS. 17-19). In still other embodiments, the core 102 can represent between one half to two thirds of the total mass of the fragmenting projectile 100, which can correspond to about one half to three quarters of the total length of the fragmenting projectile 100. Thus, it should be understood that the core 102 can represent from about one quarter to about three quarters of the total mass of the fragmenting projectile 100 and can represent from about one quarter to about three quarters of the total length of the fragmenting projectile 100. These and other embodiments of the concepts and technologies described herein will be more clearly understood with reference to the description hereinbelow.

In FIG. 1, additional structures of the fragmenting projectile 100 can be seen and will now be described. As noted above, the fragmenting projectile 100 can include two or more petals 108. The petals 108 can include branches or petals of material that are designed to provide one or more functions. According to various embodiments of the concepts and technologies described herein, the petals 108 can be designed to provide a saw like tip for the fragmenting projectile 100. Thus, the petals 108 can be used to enable the fragmenting projectile 100 to cut into or through certain media. In some embodiments, the petals 108 are configured to enable the fragmenting projectile 100 to cut into or through a hard medium such as glass, metal, wood, sheet rock, or the like. It should be understood that this example is illustrative and therefore should not be construed as being limiting in any way.

In some embodiments, the petals 108 also can be configured to open and break off or fragment from the core 102 under certain defined conditions. According to various embodiments of the concepts and technologies described herein, the petals 108 can be configured to break off of the core 102 when the fragmenting projectile 100 engages a soft medium such as liquid, gel, flesh, tissue, or the like. It should be understood that these examples are illustrative and therefore should not be construed as being limiting in any way.

According to various embodiments, the petals 108 can be configured with various shapes, dimensions, configurations, and/or relative dimensions and/or configurations. In the illustrated embodiment, the petals 108 can include a trocar tip 110. As used herein, a "trocar tip" or the word "trocar" when used to modify a structure, can be used to refer to a three-edged surface contour. According to various embodiments, the trocar tip 110 can be formed by an intersection of three surfaces, faces, or facets that meet at a point. While the trocar tip 110 is visible in FIGS. 1-8, the geometry of the trocar tip 110 is illustrated and described in more detail with reference to FIGS. 9-11 below.

The trocar tip 110 can be used to provide the fragmenting projectile 100 with a sharp piercing tip that can cut into or puncture materials. The effectiveness of the trocar tip 110 in piercing and/or cutting into materials may be particularly evident when the fragmenting projectile 100 is moving at a high rate of speed. It should be understood that this example is illustrative and therefore should not be construed as being limiting in any way.

While various embodiments of the concepts and technologies described herein are described as including a trocar tip such as the trocar tip 110 shown in the FIGURES, it should be understood that these embodiments are illustrative. In particular, in some embodiments, the multiple trocar tips 110 of the fragmenting projectile 100 (and other embodiments of the fragmenting projectile as illustrated and described hereinbelow) can be replaced by a serrated surface. Thus, some embodiments of the concepts and technologies described herein include a radially arranged serrated tip (similar to a hole saw) that can be used to provide a cutting and/or puncturing function for the fragmenting projectile 100 prior to fragmentation as described herein. Thus, some embodiments of the fragmenting projectile 100 include a serrated leading edge or tip. It should be understood that this example is illustrative and therefore should not be construed as being limiting in any way.

The petals 108 can be formed, in some embodiments, from a v-shaped channel (hereinafter referred to as a "channel") 112 that can be formed in a surface of the fragmenting projectile 100. The channel 112 can be formed by two or more facets that provide a v-shape, in some embodiments. In some other embodiments, the channel 112 can be formed using a rounded tool to create the channel 112 with a rounded surface. Thus, while the channel 112 is shown as a v-shaped channel, it should be understood that this shape is illustrative of one contemplated embodiment, and therefore should not be construed as being limiting in any way. Regardless of the shape of the channel 112, the channel 112 can be formed to provide a weak area in the fragmenting projectile 100, thereby encouraging intentional failure of the fragmenting projectile 100 at the channel 112 to create the petals 108. It should be understood that this example is illustrative and therefore should not be construed as being limiting in any way.

In some embodiments, the fragmenting projectile 100 also can include one or more break-off notches 114. The break-off notches 114 can be formed by cutting a deep channel in the fragmenting projectile 100 at selected locations. The break-off notches 114 can be used to set the region or area on the fragmenting projectile 100 at which the petals 108 will fragment or break off from the core 102 when deformation and/or expansion of the fragmenting projectile 100 is triggered. As will be illustrated and described in more detail below, the petals 108 can break off from the core 102 approximately at the level 106, though this is not necessarily the case. Because the petals 108 can break off elsewhere, and because the fragmenting projectile 100 can include additional and/or alternative structures, it should be understood that this example is illustrative and therefore should not be construed as being limiting in any way.

Figure 2:
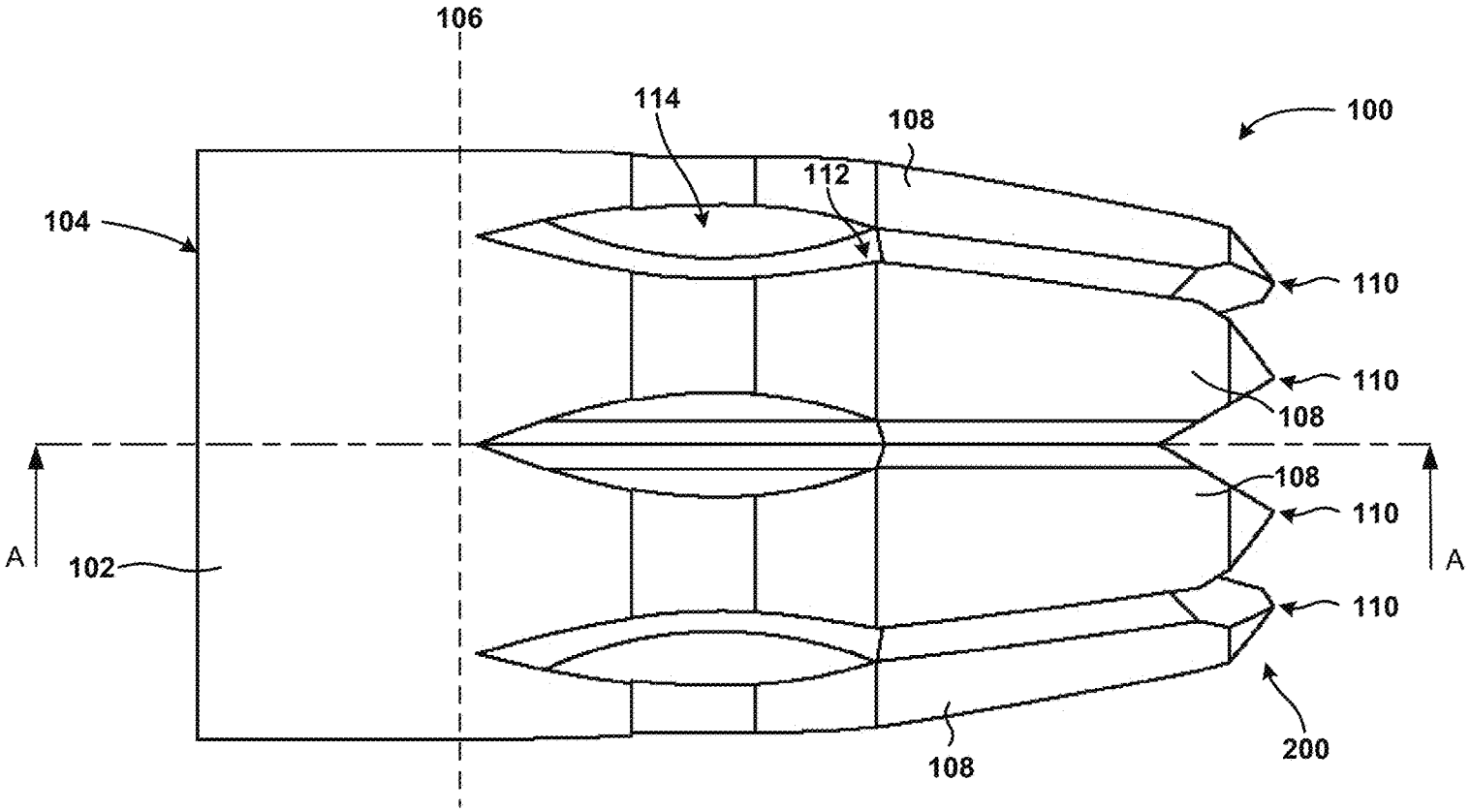
FIG. 2 is a line drawing showing a side elevation view of a fragmenting projectile, according to an illustrative embodiment of the concepts and technologies described herein.

Turning now to FIG. 2, additional aspects of the fragmenting projectile 100 will be described in detail. In particular, FIG. 2 is a side elevation view of the fragmenting projectile 100, according to one illustrative embodiment. In FIG. 2, the structures of the fragmenting projectile 100 illustrated and described with respect to FIG. 1 can be seen from another angle. In FIG. 2, the level 106 can be more easily understood. Furthermore, some of the geometry of the trocar tip 110 can be seen from FIG. 2. In FIG. 2, the geometry of the tip of the fragmenting projectile 100 can more easily be seen and will now be described.

As shown in FIG. 2, the fragmenting projectile 100 can include a saw-shaped tip 200. As can be understood and appreciated with reference to FIG. 2, the structure of the saw-shaped tip 200 can be provided by the cooperation of the trocar tips 110 of the petals 108. According to some embodiments of the concepts and technologies described herein, the saw-shaped tip 200 can provide the fragmenting projectile 100 with the ability to cut through some media in a manner that is similar to a hole saw. This functionality can be provided by the saw-shaped tip 200 and the rotational energy imparted to the fragmenting projectile 100 by rifling within a firearm that fired the fragmenting projectile 100 as well as pressure created by combustion of a propellant such as gunpowder within the chamber of the firearm.

When the saw-shaped tip 200 engages a hard medium such as wood, the saw-shaped tip 200 can puncture and cut through the hard medium. Thus, a plug from the wood or other hard medium may be located within a cavity formed by the petals 108 (visible in FIG. 3). This plug can, in some embodiments, provide rigidity for the petals 108 and prevent or delay deformation and/or intentional failure of the fragmenting projectile 100 at the channels 112 and/or break-off notches 114. As such, the saw-shaped tip 200 can provide the fragmenting projectile 100 with the ability to pierce and/or penetrate various hard media without deforming or intentionally failing when engaging a hard medium. These and other aspects of the fragmenting projectile 100 will be more fully understood with reference to the description hereinbelow.

Figure 3:
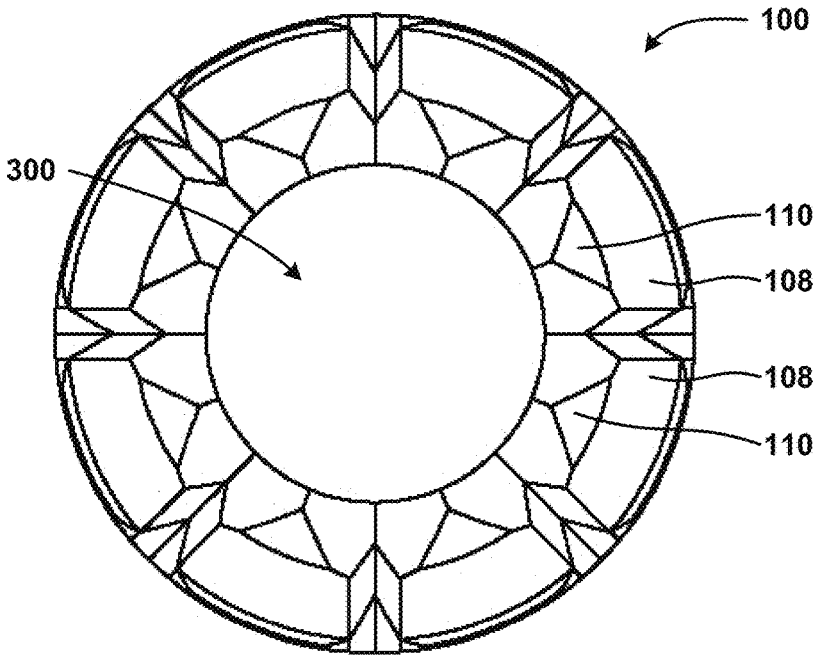
FIG. 3 is a line drawing showing a front elevation view of a fragmenting projectile, according to an illustrative embodiment of the concepts and technologies described herein.

Turning now to FIG. 3, additional aspects of the fragmenting projectile 100 will be described in detail. In particular, FIG. 3 is a front elevation view of the fragmenting projectile 100, according to one illustrative embodiment. In FIG. 3, the structures of the illustrative embodiment of the fragmenting projectile 100 illustrated and described with respect to FIGS. 1-2 can be seen from another angle. It should be understood that this example is illustrative and therefore should not be construed as being limiting in any way.

As can be seen in FIG. 3, the petals 108 can cooperate to form a cavity 300 within the fragmenting projectile 100. The cavity 300 can be a hollowed void within the fragmenting projectile 100 that enables the fragmenting projectile 100 to function as designed. In particular, as explained above, the saw-shaped tip 200 (FIG. 2) of the fragmenting projectile 100 can pierce into and/or cut through a hard medium, and the cavity 300 can be filled by the material plug created by this cutting and/or piercing. As noted above, a material plug that enters the cavity 300 can reinforce and/or provide rigidity for the petals 108, and thereby to the saw-shaped tip 200 of the fragmenting projectile 100. It should be understood that this example is illustrative and therefore should not be construed as being limiting in any way.

Additionally, or alternatively, the cavity 300 can be used to enable the fragmenting projectile 100 to fragment as designed. In particular, when the fragmenting projectile 100 engages a soft medium such as a liquid, flesh, tissue, or the like, the cavity 300 can fill with the soft medium. The petals 108 may be forced slightly inward (toward the cavity 300) at first, which may impart some bend to the petals 108, in some embodiments.

As the cavity 300 fills with soft medium under high pressure and speed (due to the movement of the fragmenting projectile 100), the soft medium can effectively (by virtue of the pressure) push out, i.e., away from the center of the cavity 300, against the petals 108, thereby encouraging the petals 108 to open and/or fragment from the core 102. Although not visible in the FIGURES, it should be understood that the petals 108 may be bent slightly from the above operations and therefore may have an arc shape. In some embodiments, the arc-shape imparted to the petals 108 by the above operations may result in the petals 108 being shaped similar to a needle for a suture kit. It should be understood that this example is illustrative and therefore should not be construed as being limiting in any way.

As can be seen with reference to FIG. 3, the trocar tips 110 can be aligned about an axis that is roughly at the center of the cavity 300, and therefore can provide a powerful cutting tool when the fragmenting projectile 100 is rotated at a typical ballistic rotation speed. It should be understood that this example is illustrative and therefore should not be construed as being limiting in any way.

Figure 4:
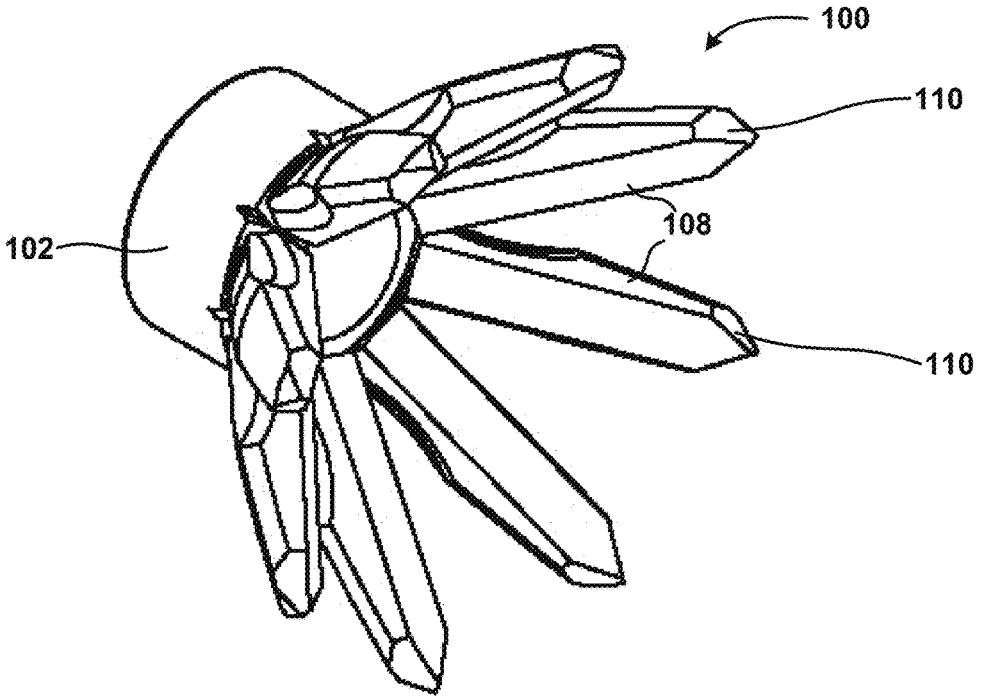
FIG. 4 is a line drawing showing a perspective view of the fragmenting projectile during use, according to an illustrative embodiment of the concepts and technologies described herein.

Turning now to FIG. 4, additional aspects of the fragmenting projectile 100 will be described in detail. In particular, FIG. 4 is a perspective view of the fragmenting projectile 100, according to one illustrative embodiment. In FIG. 4, the structures of the illustrative embodiment of the fragmenting projectile 100 illustrated and described with reference to FIGS. 1-3 are shown. In FIG. 4, however, the fragmenting projectile 100 is shown during the expansion of the fragmenting projectile 100, for example, after engaging a soft medium such as liquid, tissue, or flesh. It should be understood that this example is illustrative and therefore should not be construed as being limiting in any way.

As shown in FIG. 4, the petals 108 have opened away from the center of the cavity 300, though the petals 108 have not yet separated from the core 102. Additionally, it can be seen with reference to FIG. 4 that the petals 108 may still be connected to the core 102 at locations that are roughly equivalent to the level 106 illustrated and described with reference to FIG. 1. It should be understood that this example is illustrative and therefore should not be construed as being limiting in any way.

Depending upon desired application of the fragmenting projectile 100, the fragmenting projectile 100 can be configured open as shown in FIG. 4 without the petals 108 separating from the core 102. Thus, for example, a ductile material can be used to form the fragmenting projectile 100 to prevent fragmentation of the fragmenting projectile 100. Thus, some embodiments of the concepts and technologies described herein include non-fragmenting fragmenting projectiles 100, which may be similar or even identical to the various fragmenting projectiles 100 illustrated and described herein, though different materials may alter the performance of those fragmenting projectiles 100. It should be understood that these examples are illustrative and therefore should not be construed as being limiting in any way.

Figure 5:
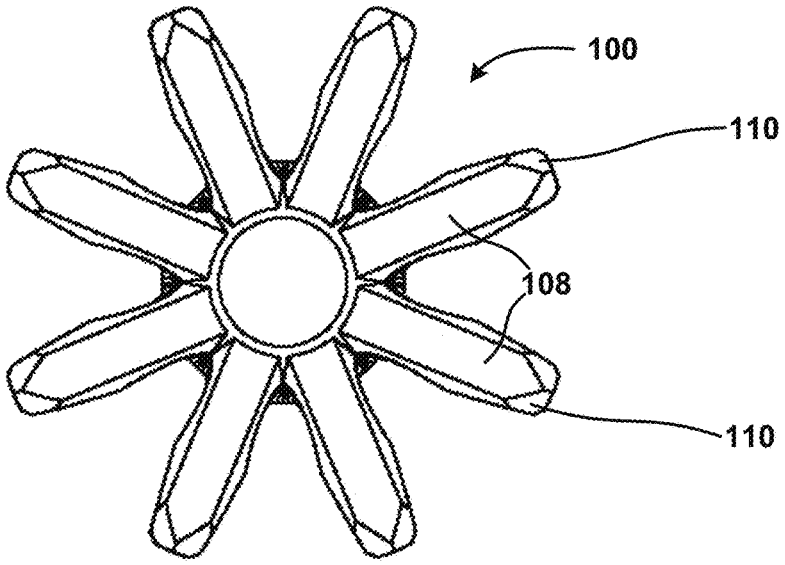
FIG. 5 is a line drawing showing a front view of the fragmenting projectile during use, according to an illustrative embodiment of the concepts and technologies described herein.
Figure 6:
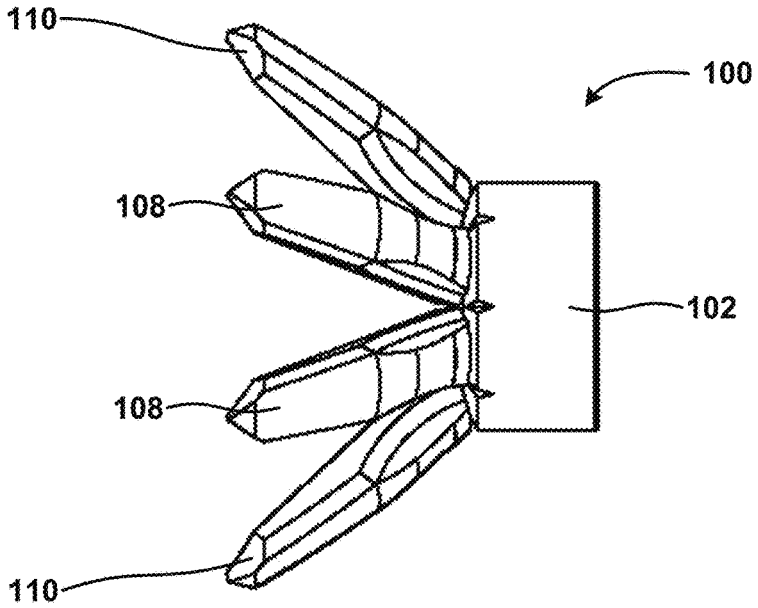
FIG. 6 is a line drawing showing a side elevation view of the fragmenting projectile during use, according to an illustrative embodiment of the concepts and technologies described herein.

Turning now to FIGS. 5-6, additional aspects of the fragmenting projectile 100 will be described in detail. In particular, FIGS. 5-6 illustrate additional views of the partially opened fragmenting projectile 100 illustrated in FIG. 4. In particular, FIG. 5 is a front elevation view of the fragmenting projectile 100 shown in FIG. 4, according to one illustrative embodiment, and FIG. 6 is a side elevation view of the fragmenting projectile 100 shown in FIGS. 4-5, according to one illustrative embodiment. The views shown in FIGS. 5-6 are provided to show how the petals 108 spread out and away from a center of the cavity 300 (as shown in FIG. 5), and how the petals 108 are attached to the core 102 at a location that approximates the level 106 shown in FIG. 1 (as shown in FIG. 6). Because the petals 108 may be bent as explained above, and because the petals 108 may spread in other manners, it should be understood that these examples are illustrative and therefore should not be construed as being limiting in any way.

Figure 7:
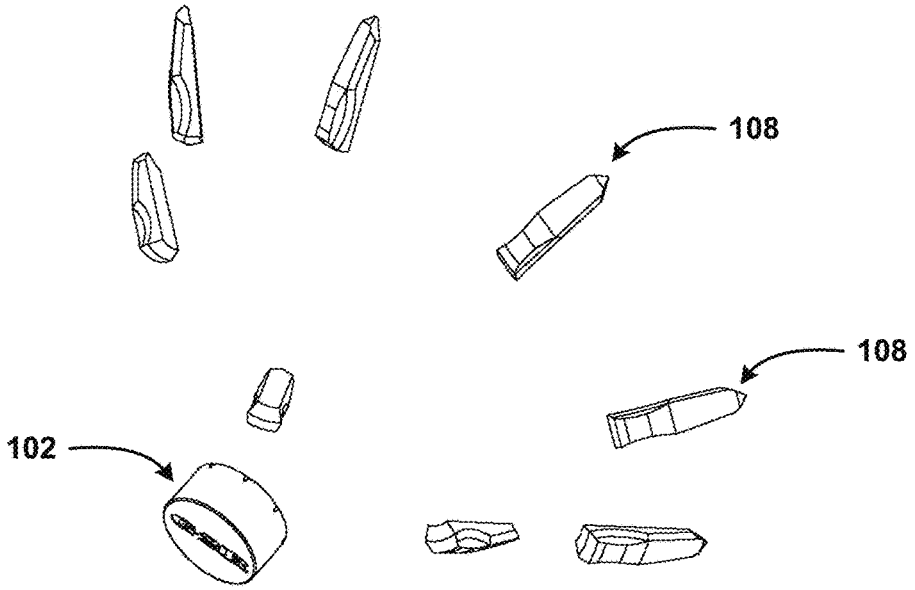
FIGS. 7-8 are line drawings showing perspective views of the fragmenting projectile during use, according to an illustrative embodiment of the concepts and technologies described herein.
Figure 8:
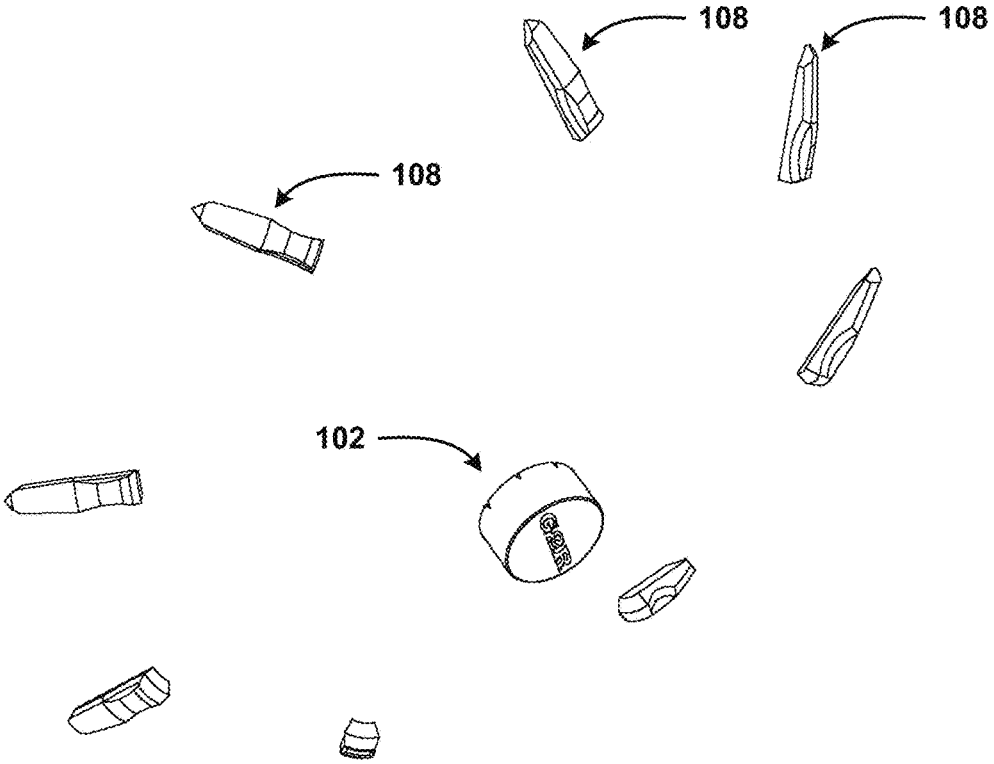

Turning now to FIGS. 7-8, additional aspects of the fragmenting projectile 100 will be described in detail. In particular, FIGS. 7-8 illustrate how the petals 108 expand away from the core 102 when the fragmenting projectile 100 engages a medium such as flesh, liquid, gel, tissue, or the like. In particular, FIG. 7 is a perspective view of a the petals 108 spreading away from the core 102, according to one illustrative embodiment, and FIG. 8 is a perspective view of the petals 108 spreading away form the core 102, according to one illustrative embodiment.

It can be appreciated with reference to FIGS. 4 and 7-8 that FIG. 7 can correspond to an intermediate configuration between the configurations shown in FIGS. 4 and 8, though this is not necessarily the case. As can be seen in FIGS. 7-8, the petals 108 can break off of the core 102 and spread out and away from the center of the cavity 300. Although not easily visible in FIGS. 7-8, the petals 108 can be slightly bent and/or can move along an arc-shaped path. The arc-shaped path will be illustrated and described in more detail below, particularly with reference to FIGS. 9-10.

Because the spreading and/or distribution of the petals 108 can be controlled by modifying various parameters of the fragmenting projectile 100, it should be understood that the illustrated embodiment is illustrative and therefore should not be construed as being limiting in any way. Furthermore, as noted above, the number of petals 108 can be varied without departing from the scope of the disclosure. Thus, the embodiment shown in FIGS. 1-10, wherein the fragmenting projectile 100 includes eight petals should not be construed as being limiting in any way.

Figure 9:
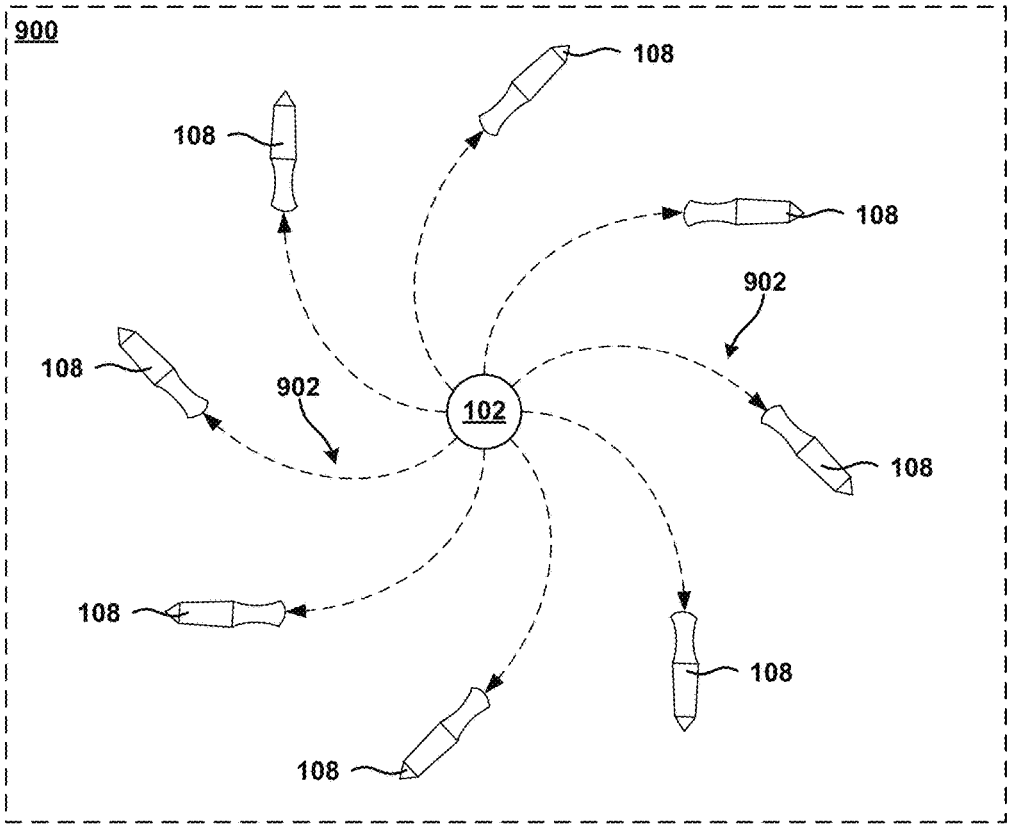
FIG. 9 is a line drawing schematically illustrating fragmentation of the fragmenting projectile, according to some illustrative embodiments of the concepts and technologies described herein.

Turning now to FIG. 9, additional aspects of the fragmenting projectile 100 will be described in detail. In particular, FIG. 9 is a line drawing schematically illustrating fragmentation of the fragmenting projectile 100, according to one illustrative embodiment. In FIG. 9, the fragmenting projectile 100 enters a medium 900 such as flesh, gel, liquid, tissue, or the like. Thus, the medium 900 can correspond to a soft medium as described herein, though this is not necessarily the case.

Upon entering the medium 900, the petals 108 of the fragmenting projectile 100 can bend outward away from the cavity 300, as explained above. As noted above, the petals 108 may first bend slightly toward the cavity 300, though this is not necessarily the case. As explained above, the fragmenting projectile 100 can be designed such that the petals 108 break away from the core 102 during bending of the petals 108. After breaking away from the core 102, the rotational energy of the fragmenting projectile 100 can be at least partially imparted to the petals 108. Similarly, the petals 108 can be moving at about the same speed as the fragmenting projectile 100, and as such, the petals 108 may be moving along a projectile path associated with the fragmenting projectile 100 at the same rate of speed as the core 102.

Figure 10:
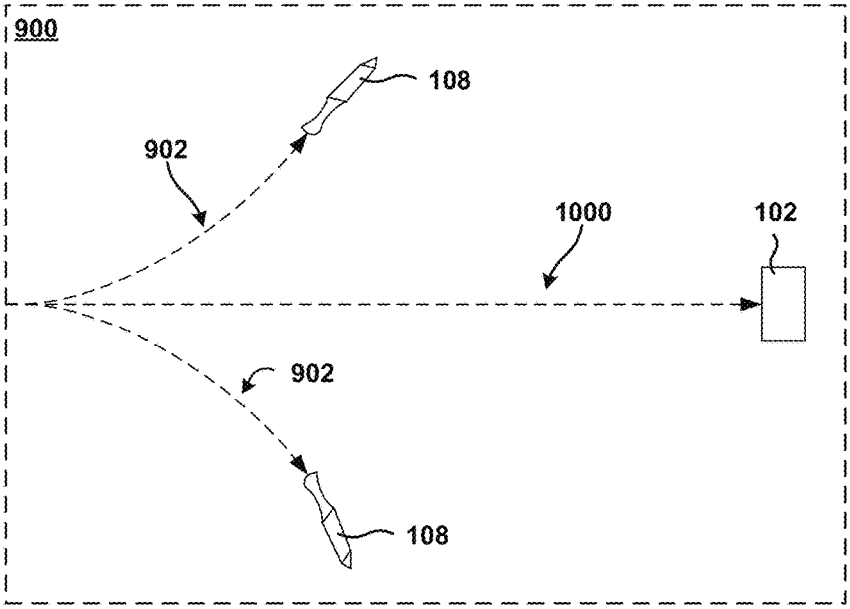
FIG. 10 is a line drawing schematically illustrating a side view of fragmentation of the fragmenting projectile, according to some illustrative embodiments of the concepts and technologies described herein.

Still further, as explained above, the petals 108 may include a slight arc-shape or bend that can cause the petals 108 to "swim" along a path 902 away from the core 102. In some embodiments, the path 902 can be an arc-shaped path. Thus, in some embodiments of the fragmenting projectile 100, the petals 108 may spread away from the core 102 along arc-shaped paths that are arc-shaped in zero, one, or even two dimensions. Thus, in some embodiments, the petals 108 can spread out along an arc-shaped path as shown in FIG. 10. In some other embodiments, the petals 108 can spread out in linear paths. In still other embodiments, the petals 108 can spread out along arc-shaped paths that are arc-shaped in two dimensions, similar to a helix shape.

The shape of the paths 902 in an embodiment wherein the petals 108 spread out along arc-shaped paths that are arc-shaped in two dimensions can be more easily understood and appreciated with collective reference to FIGS. 9-10, with FIG. 10 representing a side view of the configuration shown in FIG. 9. It should be noted that only two petals 108 are shown in FIG. 10 to avoid obscuring the view of the petals 108 and/or their respective paths 902. Furthermore, as explained above, the petals 108 can spread out along linear paths and/or other shaped paths, and as such, it should be understood that the example illustrated in FIGS. 9-10 is illustrative and therefore should not be construed as being limiting in any way.

As shown in FIG. 10, the core 102 can continue along a projectile path 1000, which can be approximately linear in some embodiments. Thus, the fragmenting projectile 100 can provide expansion and penetration, as will be illustrated and described in more detail below. Because the design of the fragmenting projectile 100 can be modified to change the paths 902 of the petals 108 and/or the projectile path 1000 of the core 102, it should be understood that this example is illustrative and therefore should not be construed as being limiting in any way.

Figure 11:
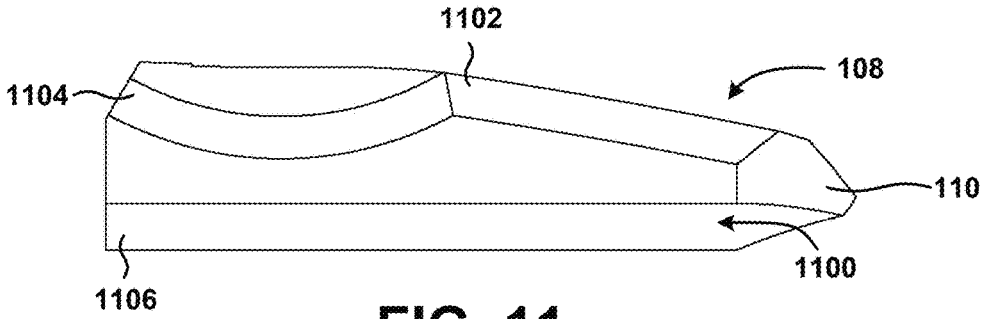
FIG. 11 is a line drawing showing a side elevation view of a petal of a fragmenting projectile, according to an illustrative embodiment of the concepts and technologies described herein.
Figure 12:
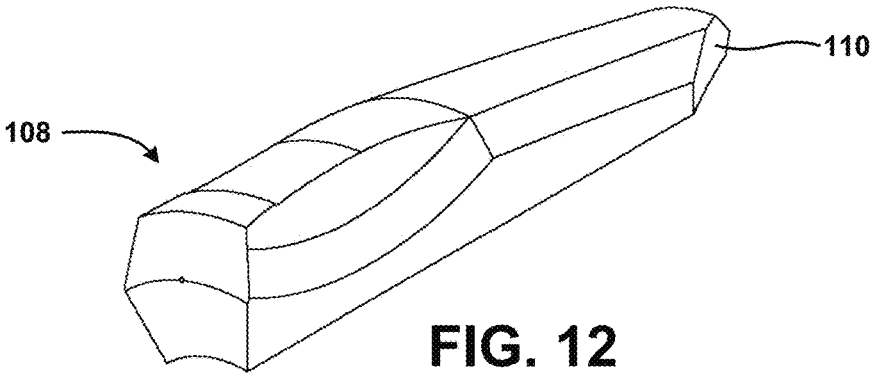
FIG. 12 is a line drawing showing a perspective view of a petal of a fragmenting projectile, according to an illustrative embodiment of the concepts and technologies described herein.
Figure 13:
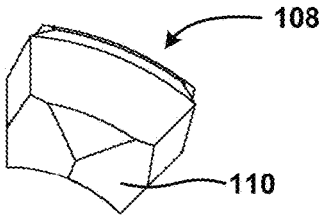
FIG. 13 is a line drawing showing a front elevation view of a petal of a fragmenting projectile, according to an illustrative embodiment of the concepts and technologies described herein.

Turning now to FIGS. 11-13, additional aspects of the fragmenting projectile 100 will be described in detail. In particular, FIGS. 11-13 illustrate various views of the petals 108, according to one example embodiment. In particular, FIG. 11 is a side elevation view of a petal 108, according to one illustrative embodiment; FIG. 12 is a perspective view of the petal 108 shown in FIG. 11, according to one illustrative embodiment; and FIG. 13 is a front elevation view of the petal 108 shown in FIGS. 11-12, according to one illustrative embodiment.

Referring first to FIG. 11, the overall shape of the petal 108 can be seen, as can additional features of the petal 108 not easily visible in FIGS. 1-10. In particular, the petal 108 has a tip 1100, which in the illustrated embodiment includes the trocar tip 110 illustrated and described above. It should be understood that some embodiments of the petal 108 can include modified trocar shapes and/or other shapes, and that the trocar tip 110 is one embodiment of the concepts and technologies described herein.

The petal 108 also can include a channel surface 1102. The channel surface 1102 can correspond to one surface of the channel 112 illustrated and described above with reference to FIG. 1. Thus, it can be appreciated that channel surfaces 1102 of two adjacent petals 108 can form the channel 112 shown in FIG. 1. It should be understood that this example is illustrative and therefore should not be construed as being limiting in any way.

The petal 108 also can include a break-off notch surface 1104. The break-off notch surface 1104 can correspond to one surface of the break-off notch 114 illustrated and described above with reference to FIG. 1. Thus, it can be appreciated that break-off notch surfaces 1104 of two adjacent petals 108 can form the break-off notch 114 shown in FIG. 1. It should be understood that this example is illustrative and therefore should not be construed as being limiting in any way.

The petal 108 also can include a side surface 1106. The side surface 1106 can correspond to a surface that is formed when two petals 108 break apart from one another during fragmentation of the fragmenting projectile 100. Thus, it can be appreciated that side surfaces 1106 of two adjacent petals 108 can be connected prior to fragmentation of the fragmenting projectile 100, and that the side surfaces 1106 may only be exposed after fragmentation of the fragmenting projectile 100. It should be understood that this example is illustrative and therefore should not be construed as being limiting in any way.

Figure 14:
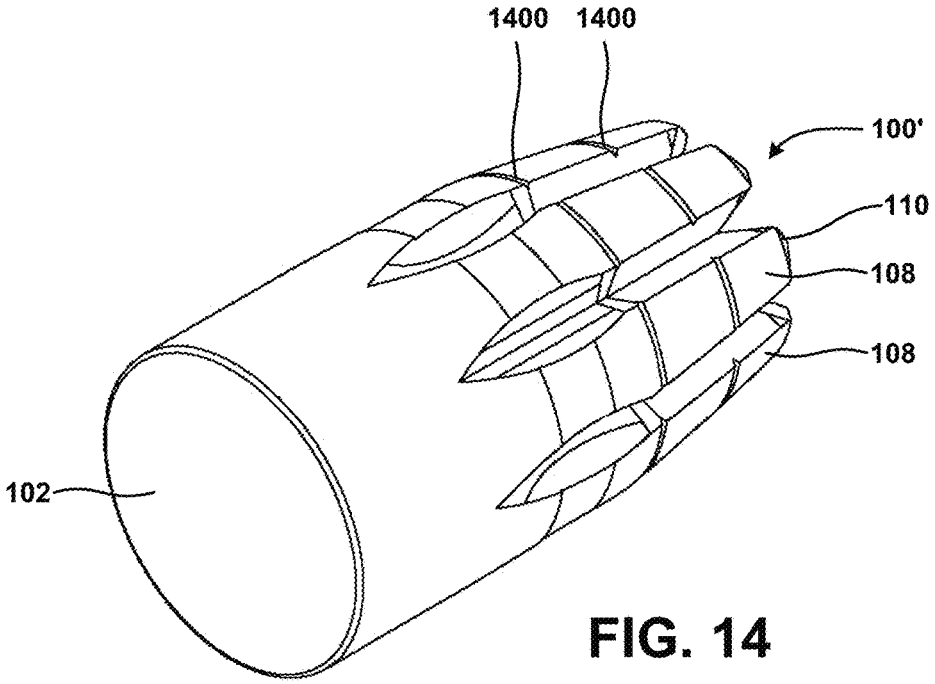
FIG. 14 is a line drawing showing a perspective view of the fragmenting projectile, according to another illustrative embodiment of the concepts and technologies described herein.
Figure 15:
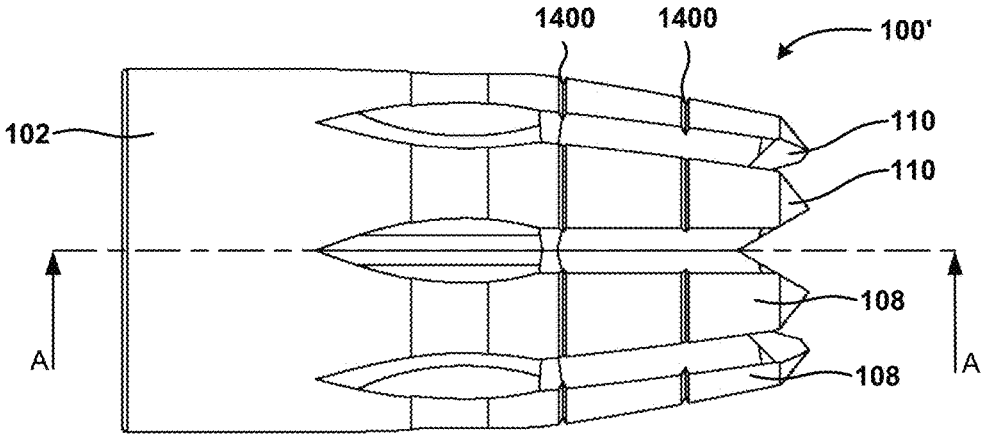
FIG. 15 is a line drawing showing a side elevation view of the fragmenting projectile, according to another illustrative embodiment of the concepts and technologies described herein.

Turning now to FIGS. 14-15, additional aspects of the fragmenting projectile 100 will be described in detail. In particular, FIGS. 14-15 illustrate various views of a fragmenting projectile 100' according to an alternative example embodiment of the concepts and technologies described herein. In particular, FIG. 14 is a perspective view of the fragmenting projectile 100', according to one illustrative embodiment, and FIG. 15 is a side elevation view of the fragmenting projectile 100' shown in FIG. 14, according to one illustrative embodiment. It should be understood that various aspects of the fragmenting projectile 100' may be similar or even identical to the various aspects of the fragmenting projectile 100 described above, and therefore are not repeated here. It also should be understood that the example of the fragmenting projectile 100' shown in FIGS. 14-15 is illustrative and therefore should not be construed as being limiting in any way.

As shown in FIG. 14, the fragmenting projectile 100' can be formed with one or more grooves 1400. The grooves 1400 can be cut into the fragmenting projectile 100' and can have various depths, shapes, and/or configurations. Although the illustrated grooves 1400 are shown as being formed as straight lines about a circumference of the fragmenting projectile 100', it should be understood that this is merely one illustrative example of the grooves 1400. In some other embodiments, the grooves 1400 are formed by passing a cutting tool down a length of the fragmenting projectile 100' while the fragmenting projectile 100' is being rotated. Thus, it can be appreciated that the grooves 1400 can be arranged in a spiral, thread, and/or helical arrangement, relative to the fragmenting projectile 100', in some embodiments. Furthermore, while the fragmenting projectile 100' is illustrated as including two grooves 1400, it should be understood that the fragmenting projectile 100' can include zero, one, two, or more than two grooves 1400 in various embodiments. Thus, the illustrated embodiment should be understood as being illustrative of one contemplated embodiment and should not be construed as being limiting in any way.

In some embodiments, the grooves 1400 can be shaped as v-shaped channels (as shown in FIGS. 14-15), and therefore can be shaped similarly relative to the channels 112 discussed above (though scaled down considerably). In some other embodiments, the grooves 1400 can have other shapes or profiles. For example, a rounded tool may be used to form the groove 1400, and as such, the groove may be rounded instead of v-shaped. Other shapes are possible and are contemplated.

In some embodiments, the v-shape of the groove 1400 may provide benefits over other shapes. In particular, the grooves 1400 can encourage the petals to bend as explained above into an arc-shape by compressing material on either side of the grooves 1400. Because the space between the top of the groove 1400 is greater than at the bottom of the groove, the petals 108 may bend into an arc-shape with the help of the grooves 1400. In some other embodiments, the grooves 1400 may not assist in bending the petals into the arc-shape, which instead can be the result of the forces inside and outside of the cavity 300 as explained above.

The grooves 1400 also can be used to alter the expansion of the petals 108. In particular, by cutting the grooves 1400 deeper and/or increasing the number of grooves 1400, the expansion and breakaway of the petals 108 can be hastened. In particular, as the grooves 1400 are made deeper and/or the number of grooves 1400 is increased, the rate at which the petals 108 expand and/or breakaway from the core 102 can be increased. Similarly, as the depth of the grooves 1400 is lessened and/or the number of grooves 1400 is reduced, the rate at which the petals 108 expand and/or breakaway from the core 102 can be decreased.

As such, the grooves 1400 can be altered to increase or decrease the rate of fragmentation of the fragmenting projectile 100', and thereby the penetration of the core 102 into the target. In particular, in some embodiments of the fragmenting projectile 100, 100', penetration of the core 102 can be related to the fragmentation of the petals 108. The relationship, however, may not be a linear relationship. In particular, the if the petals 108 break off immediately after engaging a soft medium, the core 102 may not penetrate as deeply as the core 102 may penetrate if the petals 108 break off slightly after engaging the soft medium. Similarly, if the petals 108 break off slightly after engaging the soft medium, the core 102 may not penetrate as deeply as the core 102 may penetrate if the petals 108 break off even longer after engaging the soft medium. Still further, however, penetration may begin to decrease again if the petals 108 break off too long after the fragmenting projectile 100, 100' engages the medium.

Thus, various parameters of the fragmenting projectile 100, 100' may be adjusted to create a fragmenting projectile 100, 100' with ideal penetration and expansion. As explained above, the parameters that may be adjusted include, but are not limited to, mass of the fragmenting projectile 100, 100'; speed of the fragmenting projectile 100, 100'; mass and/or dimensions (e.g., radius, length, etc.) of the core 102; mass and/or dimensions (e.g., length, width, thickness, angles, etc.) of the petals 108; numbers and/or configurations of the petals 108; presence, number, depth, and/or configurations of the grooves 1400; material selection and/or characteristics for the fragmenting projectile 100, 100'; dimensions (e.g., radius and/or radii, depth, etc.) and/or configuration of the cavity 300; combinations thereof; or the like. As such, these and other parameters of the fragmenting projectile 100, 100' can be adjusted for various performance needs and/or desires. It should be understood that these examples are illustrative and therefore should not be construed as being limiting in any way.

Figure 16:
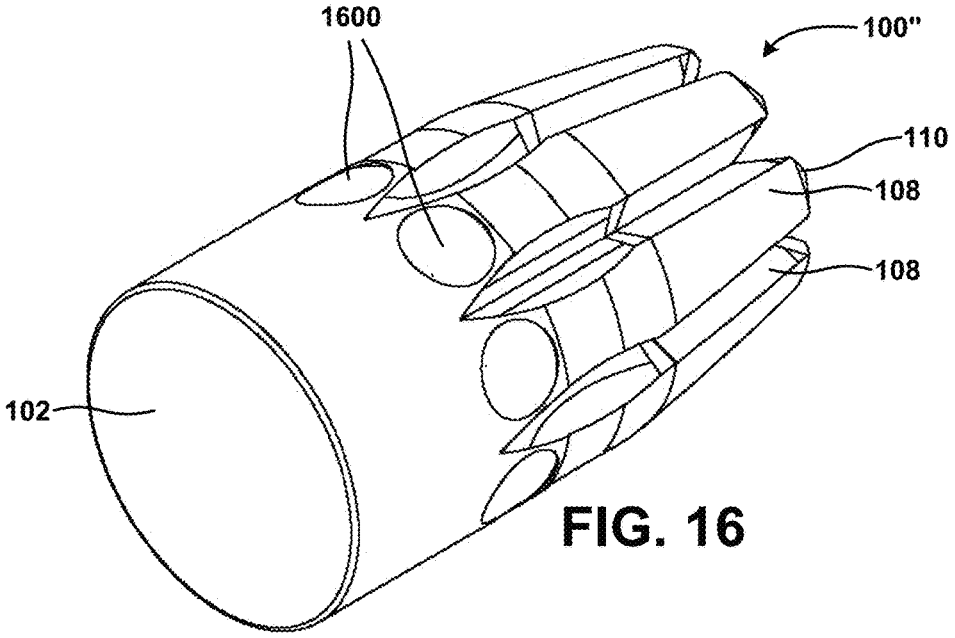
FIG. 16 is a line drawing showing a perspective view of the fragmenting projectile, according to still another illustrative embodiment of the concepts and technologies described herein.

Turning now to FIGS. 16-17, additional aspects of the fragmenting projectile 100 will be described in detail. In particular, FIGS. 16-17 illustrate various views of a fragmenting projectile 100" according to an alternative example embodiment of the concepts and technologies described herein. In particular, FIG. 16 is a perspective view of the fragmenting projectile 100", according to one illustrative embodiment, and FIG. 17 is a side elevation view of the fragmenting projectile 100" shown in FIG. 16, according to one illustrative embodiment. It should be understood that various aspects of the fragmenting projectile 100" may be similar or even identical to the various aspects of the fragmenting projectile 100, 100' described above, and therefore are not repeated here. It also should be understood that the example of the fragmenting projectile 100" shown in FIGS. 16-17 is illustrative and therefore should not be construed as being limiting in any way.

As shown in FIG. 16, the fragmenting projectile 100" can be formed with one or more perforations, weak points, or dimples ("dimples") 1600. The dimples 1600 can be formed in the fragmenting projectile 100" and can have various depths, shapes, and/or configurations. Furthermore, while the fragmenting projectile 100" is illustrated as including a single dimple 1600 on each petal 108, it should be understood that the fragmenting projectile 100" can include zero, one, or more than one dimple 1600 on zero, one, or more than one of the petals 108. Thus, the illustrated embodiment should be understood as being illustrative of one contemplated embodiment and should not be construed as being limiting in any way.

According to some embodiments, the dimples 1600 can be provided to weaken material of the fragmenting projectile 100" at a base of the petal 108 (e.g., at or near the level 106 illustrated and described in FIG. 1). Thus, the dimples 1600 can be used to remove material at the bottom of the petal 108, thereby encouraging failure of the material at or near the dimple 1600. Thus, the dimples 1600 can be used to control where the petals 108 break off from the core 102. It should be understood that this example is illustrative and therefore should not be construed as being limiting in any way.

In some embodiments, the dimples 1600 can be formed by drilling the petals 108 to create weak points for control. In some embodiments, the dimples 1600 can be formed in the core 102, while in other embodiments, the dimples 1600 can be formed on the petals 108 themselves (e.g., on the surface of the petals 108 at the level of the cavity 300). The dimples 1600 can be formed at the bottom of the cavity 300, centered on the plane of the bottom of the cavity 300, partially into the surface at any point above or below the plane, and/or elsewhere. While the dimples 1600 are illustrated in FIGS. 16-17 as round indentations, it should be understood that the dimples 1600 may not be round in some embodiments, as other contemplated embodiments include dimples 1600 that are semicircular, v-shaped, and/or other shapes. As such, the illustrated embodiment should be understood as being illustrative and should not be construed as being limiting in any way.

In one contemplated embodiment of the concepts and technologies described herein, the dimples 1600 can be formed as perforations that extend into the cavity 300, thereby providing a path through which air, water, and/or other media within the cavity 300 can pass to the outside of the fragmenting projectile 100". In this embodiment, the dimples 1600 (in this case perforations), can be used to relieve pressure created by a plug of material within the cavity 300, for example a plug the fragmenting projectile 100" cut upon entry into a target. In this embodiment, the dimples 1600 (or perforations) can be used to require a harder material to force separation of the petals 108 and/or to cause the petals 108 to separate first from the core 102 as opposed to opening up from the front tip (where the trocar tips 110 are located). Thus, some embodiments of the fragmenting projectile 100" are designed such that the hydrostatic forces within the cavity 300 exceed the tensile strength of the material and the weak points created by the dimples 1600 (perforations) drilled near the center of the material surrounding the cavity 300.

The dimples 1600 (or perforations) can be drilled into the fragmenting projectile 100" at angle to give the petals 108 different shapes or to cause the petals 108 to react to certain materials. In one embodiment, for example, the dimples 1600 are formed as perforations that are drilled at a forty-five degree angle relative to the surface of the fragmenting projectile 100" from below the bottom of the cavity 300 to the corner of the bottom of the cavity 300. In this embodiment, the core 102 can have a predetermined shape similar to the tapered shape of the fragmenting projectile 100" before fragmentation, though the core 102 may not be hollow and may have a shorter length. It should be understood that this example is illustrative and therefore should not be construed as being limiting in any way.

It should be understood that the shape and depth of the cavity 300 can be a major factor in the manner in which the fragmenting projectile 100, 100', 100" reacts to impact and the resulting shape after separation of the petals 108. Thus, the parameters discussed above for modifying performance and/or behavior of the fragmenting projectile 100, 100', 100" can include the presence and/or configuration of the dimples. It should be understood that these examples are illustrative and therefore should not be construed as being limiting in any way.

Turning now to FIGS. 18-21, additional aspects of the fragmenting projectile 100 will be described in detail. In particular, FIGS. 18-21 illustrate various cutaway views of a fragmenting projectile 100, 100', 100" according to various example embodiments of the concepts and technologies described herein. Specifically, the cutaway views shown in FIGS. 18-21 can correspond to a view of the fragmenting projectile 100 cut along the line A-A in FIG. 2, a view of the fragmenting projectile 100' cut along the line A-A in FIG. 15, and/or a view of the fragmenting projectile 100" cut along the line A-A in FIG. 17. Because the cutaway views can correspond to any of the fragmenting projectiles 100, 100', 100" described herein above, FIGS. 18-21 will be described with reference only to fragmenting projectile 100, the core 102, and the cavity 300 for simplicity.

Turning first to FIG. 18, a cutaway view of the fragmenting projectile 100 according to one illustrative embodiment is shown. As shown in FIG. 18, the cavity 300 can approximate a cylinder in shape. Similarly, the core 102 can be substantially flat at a surface 1800 that contacts the cavity 300. Thus, in some embodiments, the thickness of the petals 108 can be greater toward the surface 1800 relative to the tip 1802 near the opening of the cavity 300. Thus, as can be seen in the above FIGURES, the core 102 can be a relatively short cylindrical piece of material after the petals 108 break off from the core 102. It should be understood that this example is illustrative and therefore should not be construed as being limiting in any way.

Turning now to FIG. 19, a cutaway view of the fragmenting projectile 100 according to one illustrative embodiment is shown. As shown in FIG. 19, the core 102 can also be formed with other structures or shapes at a surface that borders the cavity 300. In the illustrated embodiment, the core 102 is illustrated as having a pointed structure ("point") 1900. The point 1900 can be formed with a cone shape. It should be appreciated that the point 1900 also can be formed with a trocar shape, a pyramid shape, and/or other pointed shapes, if desired. Thus, the core 102 can include a cylindrical piece of material with a point 1900 after the petals 108 break off from the core 102. In some embodiments, this shape can increase the penetration of the core 102 into the target, relative to the embodiment shown in FIG. 18, though this is not necessarily the case. It should be understood that this example is illustrative and therefore should not be construed as being limiting in any way.

Figure 20:
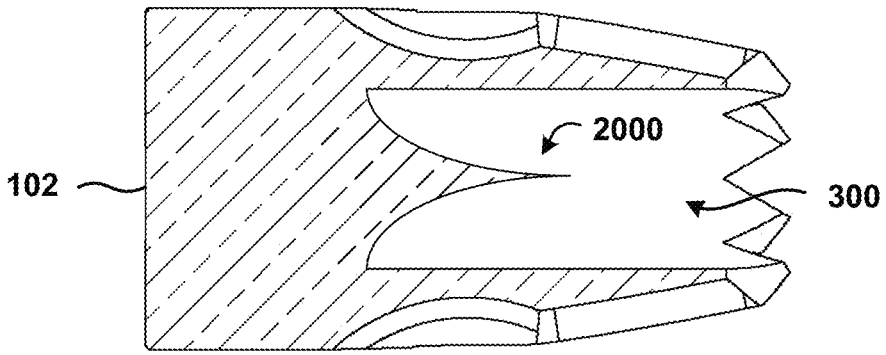

Turning now to FIG. 20, a cutaway view of the fragmenting projectile 100 according to one illustrative embodiment is shown. As shown in FIG. 20, the core 102 can include a tapered point 2000. The tapered point 2000 may be easier or more difficult to form, relative to the point 1900. Thus, the core 102 can include a cylindrical piece of material with a tapered point 2000 after the petals 108 break off from the core 102. In some embodiments, this shape can further increase the penetration of the core 102 into the target, relative to the embodiment shown in FIG. 19, though this is not necessarily the case. It should be understood that this example is illustrative and therefore should not be construed as being limiting in any way.

Figure 21:
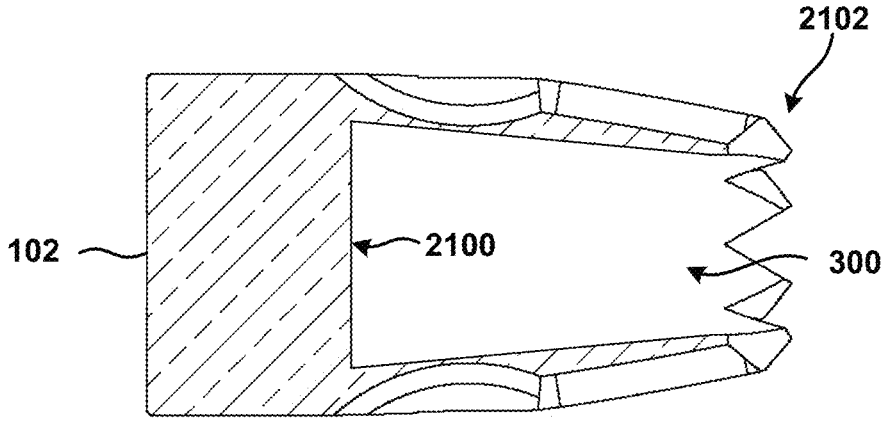

Turning first to FIG. 21, a cutaway view of the fragmenting projectile 100 according to one illustrative embodiment is shown. As shown in FIG. 21, the cavity 300 can approximate a cylinder in shape, but can be wider at the bottom 2100 than the top 2102. Similarly, the core 102 can be substantially flat at a surface that contacts the bottom 2100 of the cavity 300. Thus, in some embodiments, the thickness of the petals 108 can be substantially equal along the length of the fragmenting projectile 100. The core 102 shown in FIG. 21 can be substantially similar to the core 102 shown in FIG. 18. Thus, the core 102 shown in FIG. 21 can be a relatively short cylindrical piece of material after the petals 108 break off from the core 102. It should be understood that this example is illustrative and therefore should not be construed as being limiting in any way.

Figure 22:
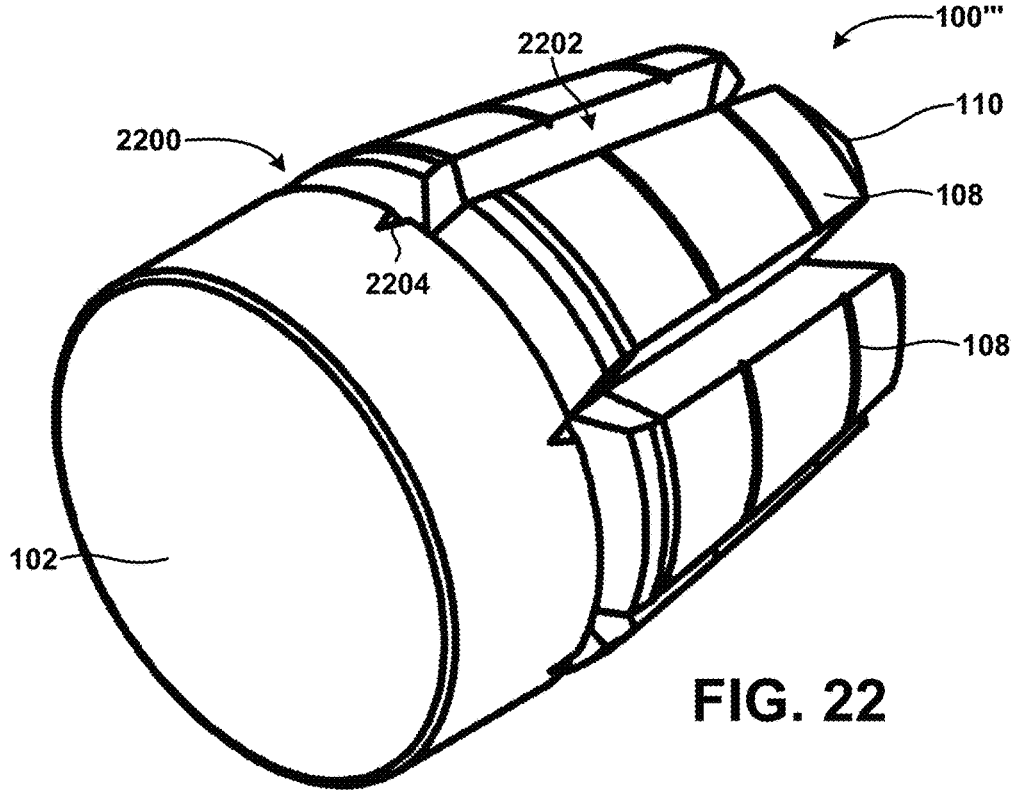
FIG. 22 is a line drawing showing a perspective view of the fragmenting projectile, according to yet another illustrative embodiment of the concepts and technologies described herein.
Figure 23:
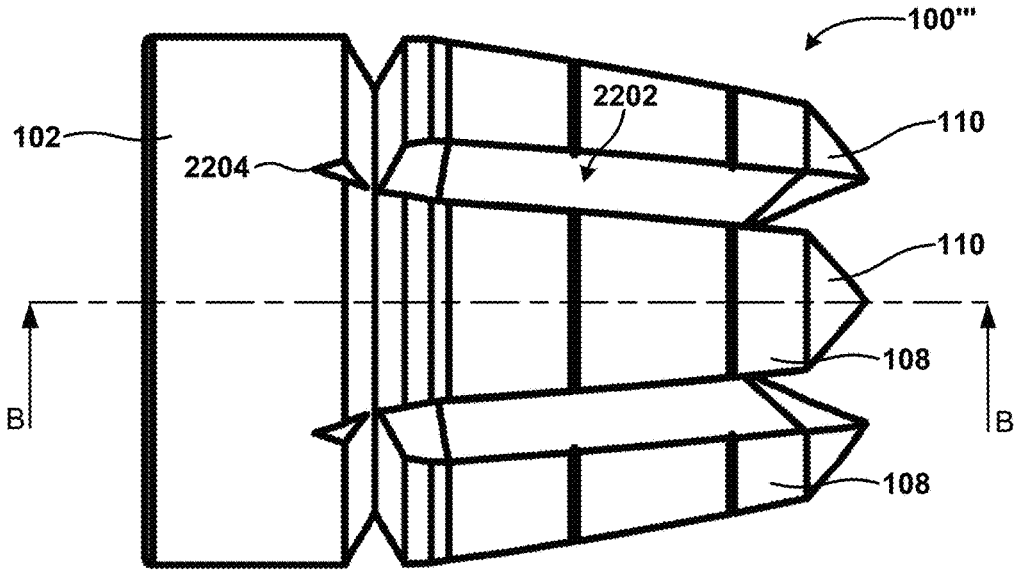
FIG. 23 is a line drawing showing a side elevation view of the fragmenting projectile, according to yet another illustrative embodiment of the concepts and technologies described herein.
Figure 24:
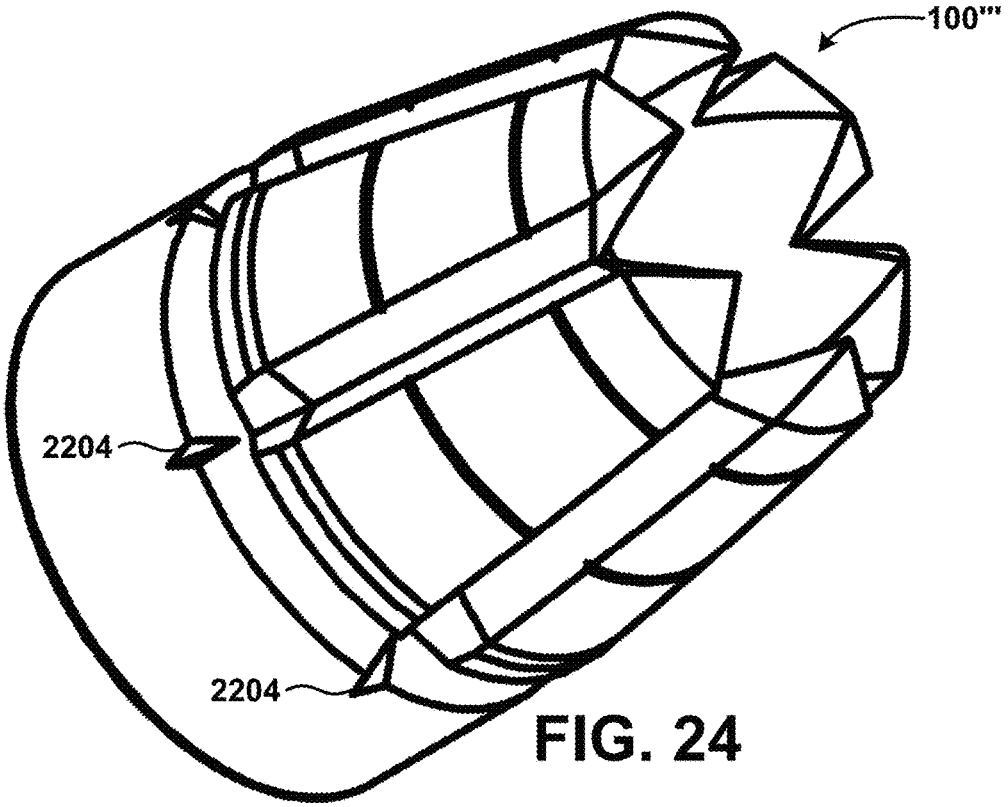
FIG. 24 is a line drawing showing a perspective view of the fragmenting projectile, according to another illustrative embodiment of the concepts and technologies described herein.
Figure 25:
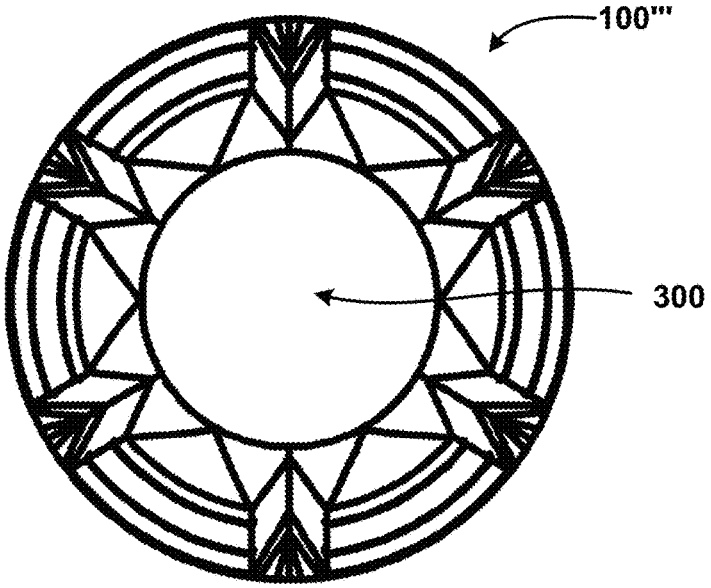
FIG. 25 is a line drawing showing a side elevation view of the fragmenting projectile, according to another illustrative embodiment of the concepts and technologies described herein.

Turning now to FIGS. 22-25, additional aspects of the fragmenting projectile 100 will be described in detail. In particular, FIGS. 22-25 illustrate various views of a fragmenting projectile 100''' according to an alternative example embodiment of the concepts and technologies described herein. In particular, FIG. 22 is a perspective view of the fragmenting projectile 100''', according to one illustrative embodiment, FIG. 23 is a side elevation view of the fragmenting projectile 100''' shown in FIG. 22, FIG. 24 is another perspective view of the fragmenting projectile 100''' shown in FIGS. 22-23, and FIG. 25 is a front elevation view of the fragmenting projectile 100''' shown in FIGS. 22-24, all according to one illustrative embodiment. It should be understood that some aspects of the fragmenting projectile 100''' may be similar or even identical to the various aspects of the fragmenting projectile 100, 100', and/or 100'' described above, and therefore are not repeated here. It also should be understood that the example of the fragmenting projectile 100''' shown in FIGS. 22-25 is illustrative and therefore should not be construed as being limiting in any way.

As shown in FIG. 22, the fragmenting projectile 100''' can be formed with one or more breakoff grooves 2200. The breakoff grooves 2200 can be formed in the fragmenting projectile 100''' and can have various depths, shapes, and/or configurations. While the illustrated embodiment of the fragmenting projectile 100''' includes only one breakoff groove 2200, it should be understood that the fragmenting projectile 100''' can include zero, one, or more than one breakoff groove 2200. Furthermore, while the breakoff groove 2200 is illustrated as having a v-shape (best seen in FIG. 23), it should be understood that the breakoff groove 2200 can have other shapes. For example, the breakoff groove 2200 can be formed with a rounded tool and therefore can have a radius, for example. Thus, the illustrated embodiment should be understood as being illustrative of one contemplated embodiment and should not be construed as being limiting in any way.

According to some embodiments, the breakoff grooves 2200 can be provided to encourage failure of the material used to form the fragmenting projectile 100''' at a base of the petal 108 (e.g., at or near the level of the breakoff groove 2200). Thus, the breakoff grooves 2200 can be used to remove material at the bottom of the petal 108, thereby encouraging failure of the material at or near the breakoff groove 2200. The breakoff grooves 2200 can be used in some calibers where the length of the fragmenting projectile 100''' may reduce the speed at which the petals 108 break off from the core 102 without the breakoff grooves 2200. It should be understood that this example is illustrative and therefore should not be construed as being limiting in any way.

As can be seen in FIGS. 22-25, the fragmenting projectile 100''' can also include channels 2202. The channels 2202 can be substantially similar to the channels 112 illustrated and described above, though this is not necessarily the case. As can be seen in FIGS. 22-23 and 24, the breakoff groove 2200 can pass through portions of the channels 2202, in some embodiments. As such, the fragmenting projectile 100''' can include a notch 2204 below the breakoff groove 2200, wherein the notch 2204 can be lined up with the channels 2202. In some embodiments, the notches 2204 can provide the core 102 with a serrated edge and/or encourage penetration by the core 102. In some other embodiments, the notches 2204 are merely manufacturing remnants that serve no specific purpose. Thus, while the notches 2204 can have a designated function, this is not necessarily the case. It should be understood that this example is illustrative and therefore should not be construed as being limiting in any way.

Figure 26:
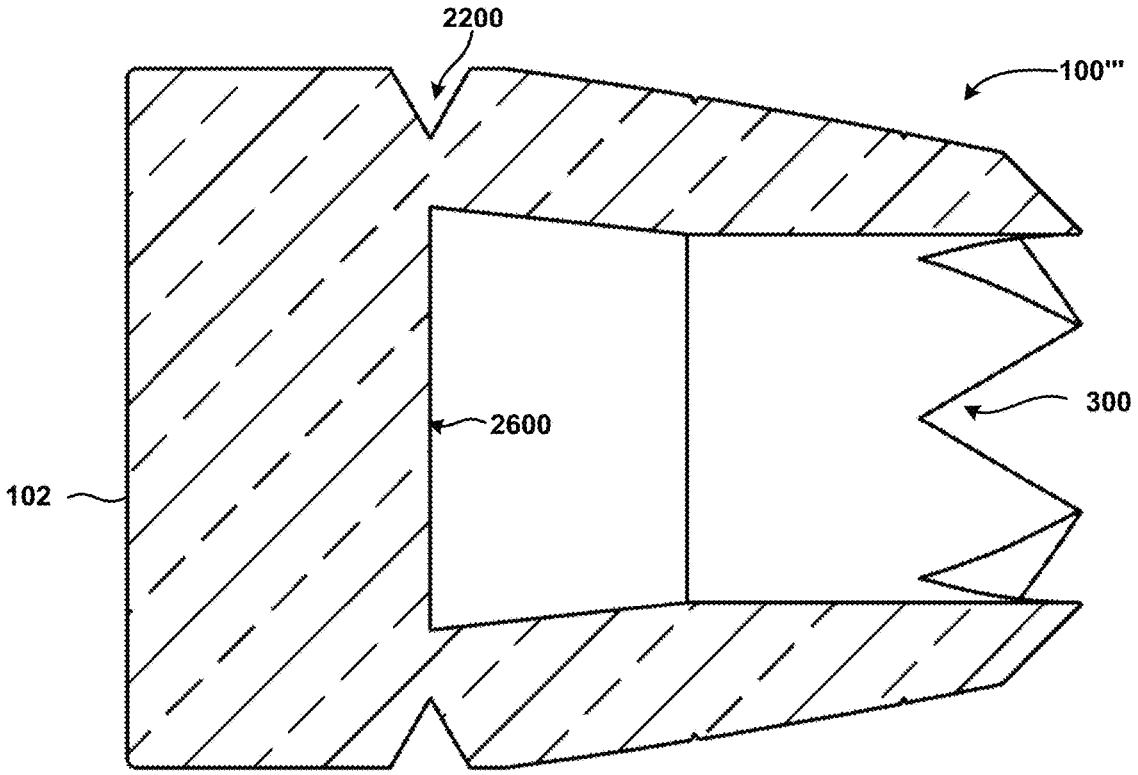
FIG. 26 is a line drawing showing a cut-away view of fragmenting projectiles, according to other embodiments of the concepts and technologies described herein.

Turning now to FIG. 26, additional aspects of the fragmenting projectile 100''' will be described in detail. In particular, FIG. 26 illustrates a cutaway view of the fragmenting projectile 100''', according to an example embodiment of the concepts and technologies described herein. Specifically, the cutaway view shown in FIG. 26 can correspond to a view of the fragmenting projectile 100''' cut along the line B-B in FIG. 23.

As shown in FIG. 26, the cavity 300 can approximate a cylinder in shape, though a rear portion of the cavity 300 (i.e., an end of the cavity 300 nearest the front surface 2600 of the core 102) can be wider than a front portion of the cavity 300. Thus, in some embodiments, the thickness of the petals 108 can be greater or less at various points along the lengths of the petals 108, though this is not necessarily the case. Furthermore, as can be appreciated with collective reference to FIGS. 22-26, the breakoff groove 2200 can be located in line with the front surface 2600 of the core 102, though this is not necessarily the case. Thus, as can be seen in the above FIGURES, the core 102 can be a relatively short cylindrical piece of material after the petals 108 break off from the core 102. It should be understood that this example is illustrative and therefore should not be construed as being limiting in any way.

Figure 27:
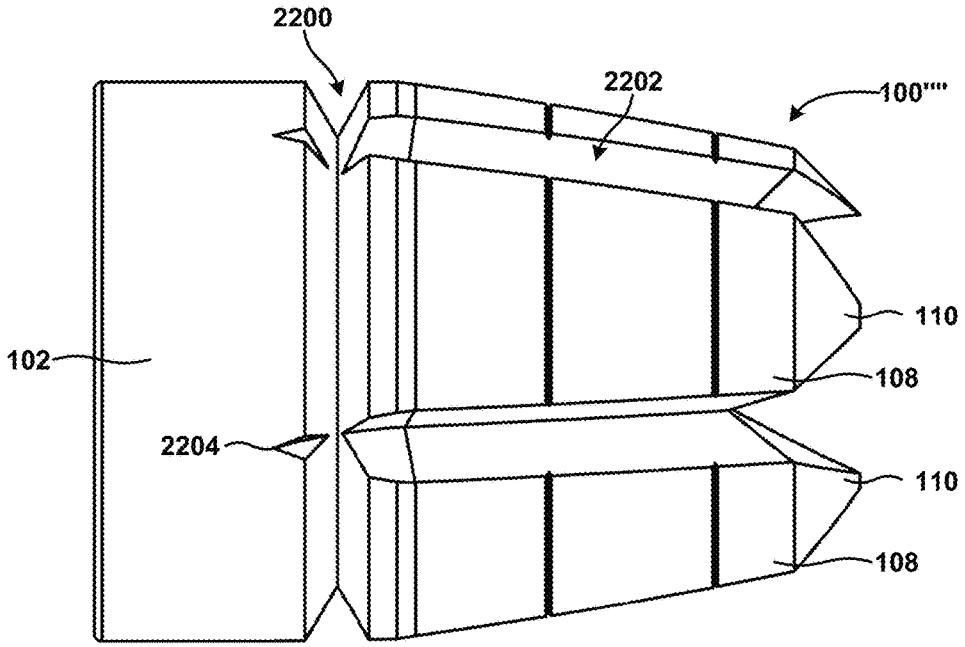
FIG. 27 is a line drawing showing a side elevation view of the fragmenting projectile, according to yet another illustrative embodiment of the concepts and technologies described herein.
Figure 28:
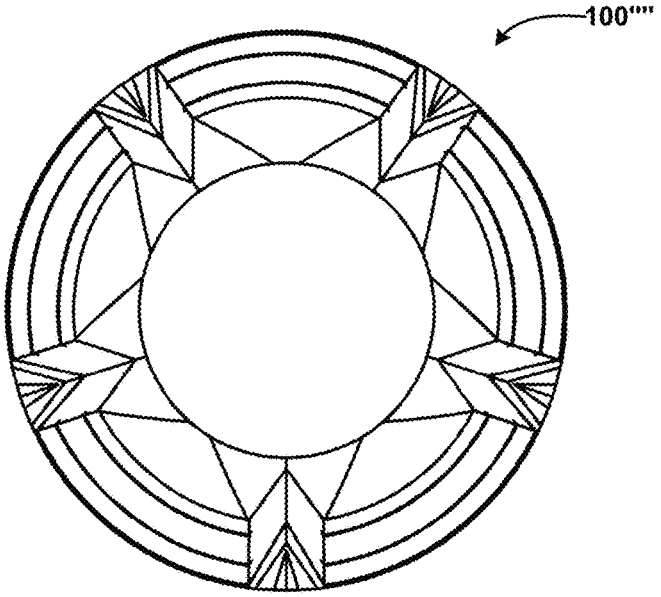
FIG. 28 is a line drawing showing a front elevation view of the fragmenting projectile, according to yet another illustrative embodiment of the concepts and technologies described herein.

Turning now to FIGS. 27-28, aspects of a fragmenting projectile 100"" will be described in detail. In particular, FIGS. 27-28 illustrate various views of a fragmenting projectile 100"" according to an alternative example embodiment of the concepts and technologies described herein. In particular, FIG. 27 is a perspective view of the fragmenting projectile 100"", according to one illustrative embodiment, and FIG. 28 is a front elevation view of the fragmenting projectile 100"" shown in FIG. 22, according to one illustrative embodiment. It should be understood that some aspects of the fragmenting projectile 100"" may be similar or even identical to the various aspects of the fragmenting projectile 100, 100', 100", and/or 100'" described above, and therefore are not repeated here. It also should be understood that the example of the fragmenting projectile 100"" shown in FIGS. 27-28 is illustrative and therefore should not be construed as being limiting in any way. As can be seen in FIGS. 27-28, the fragmenting projectile 100"" can include five petals 108. Thus, as explained above, some embodiments of the concepts and technologies described herein include two or more petals 108, five petals 108, six petals 108 (as shown in FIGS. 22-26), eight petals 108 (as shown in FIGS. 1-21), and/or more than eight petals 108. Other than the number of petals 108, the fragmenting projectile 100"" can be substantially similar to the fragmenting projectile 100, 100', 100", 100'" illustrated and described above. Thus, while the illustrated fragmenting projectile 100"" is substantially similar to the fragmenting projectile 100'", it should be understood that this is merely an example. As such, it should be understood that this example is illustrative and therefore should not be construed as being limiting in any way.

In the above description, various structural elements of the fragmenting projectiles 100, 100', 100" have been described. Various aspects of the various embodiments of the fragmenting projectile 100, 100', 100" now will be described in detail. Because the following description and features can apply equally to any of the fragmenting projectiles 100, 100', 100" described herein above, these features and description will reference only the fragmenting projectile 100 and its respective components for simplicity. It should be understood that this example is illustrative and therefore should not be construed as being limiting in any way.

The fragmenting projectile 100 is designed to expend as much energy as possible within a target. Upon contacting a target, the fragmenting projectile 100 is rotating and moving rapidly due to forces within the barrel of the firearm from which the fragmenting projectile 100 was fired. Upon entering the target, the fragmenting projectile 100 begins to slow, and the cavity 300 fills with material from the target. The material enters the cavity 300 and forces the petals 108 outward (away from the cavity 300), until the petals 108 fracture or split from the core 102.

In particular, upon entering the target, hydrodynamic pressure associated with a reduced area of the trocar tip 110 can decelerate the fragmenting projectile 100, thereby causing the front rim of the fragmenting projectile 100 to decelerate. As the fragmenting projectile 100 decelerates, the petals 108 can open by bending outward away from the cavity 300 as illustrated and described above. The hydrostatic pressure can build up further, thereby pushing the fragmenting projectile 100 apart at the channels 112, the break-off notches 114, and/or the dimples 1600 on an outer surface of the fragmenting projectile 100. When the petals 108 are pushed to a chosen number of degrees (which can be set by modifying parameters as disclosed herein), the petals 108 can split off of the core 102 and be propelled away from the core 102 and into the target.

Due to the petals 108 splitting off of the core 102, the mass of the core 102 is reduced significantly. As explained above, the core 102 can include from about one quarter to about three quarters of the total mass of the fragmenting projectile 100. Thus, the sudden reduction of mass of the core 102 can limit the penetration of the core 102 into the target to reduce the odds that the core 102 will pass through the target. Furthermore, the petals 108 carry with them some of the energy from the fragmenting projectile 100 individually, which will push the petals 108 into the target. Although not easily discernible in FIGS. 9-10, a cross-sectional thicknesses and geometry of the petals 108 can cause a full 180 degree flip by the petals 108 as they disperse through the target and away from the path of the core 102. It should be understood that this example is illustrative and therefore should not be construed as being limiting in any way.

The shape of the petals 108 and the point during opening of the petals 108 at which the petals separate from the core 102 generally results in the petals 108 spreading at about a sixty degree angle relative to the original path of the fragmenting projectile 100. Drag on the petals 108 induced by the medium through which the petals 108 move push the petals 108 to expand outward beyond a diameter of the original fragmenting projectile 100. This movement of the petals 108 can create a shock wave or otherwise cause creation of a temporary void in the target or other medium. The temporary void created by the movement of the petals 108 can cause the core 102 to pass through the target or temporary void with less resistance than otherwise would be encountered (without the spreading petals 108 to create the temporary void). Thus, the core 102 can move into the target before encountering full resistance of the medium associated with the target. This, in turn, can increase penetration of the core 102 into the target, in some embodiments. As explained above, the penetration of the core 102 can be controlled by controlling various parameters of the fragmenting projectile 100.

As noted above, paths of the petals 108 within the target may not be linear after they have separated from the core 102. Due to the rotation of the fragmenting projectile 100 before engaging the target, the petals 108 may have a tendency to travel in an arc. Because the petals 108 can be formed with a trocar tip 110, the petals 108 may attain a great distance of travel due to a low resistance shape. This movement in an arc can increase the likelihood of a petal 108 contacting a vital organ within the target. It has been noted that the petals 108 also can rotate end over end predictably over their distance of travel, which further can increase the destructive effect of the petals 108 within the target. Modifications to the tip of the petal 108 or the tail can be made to affect how the petals 108 pass through a material.

In some embodiments, the fragmenting projectile 100 can be equated to a hole saw or cutter that is rotating. Thus, the trocar tips 110 of the fragmenting projectile 100 can, based upon their rotation, pierce into and/or cut through various media such as sheetrock, wood, glass, or the like. The fragmenting projectile 100 can impart a torsional effect in the direction of rotation it in effect is cutting a hole in the soft material as the material resists this rotation additional energy is also dissipated. This is another factor in design that imparts control on the bullets performance. This can be a determining factor in how deep the projectile travels before the petals 108 separate from the core 102.

The fragmenting projectile 100 can be formed using various manufacturing processes and/or tools. In some embodiments, the fragmenting projectile 100 is die cast as one piece and/or as two pieces that are later joined together. In some other embodiments, the fragmenting projectile 100 can be formed from a solid piece of material that can be machined using routers, mills, lathes, and/or various CNC machines, as generally is understood. Thus, in some embodiments the fragmenting projectile 100 is formed from a single piece of material, while in other embodiments the fragmenting projectile 100 is formed from multiple pieces of material.

Similarly, various machining techniques can be used. In particular, a machine tool similar to a 60-degree "thread cutting" bit may be used to create the trocar tips 110 and/or the channels 112. Other tools having other angles may also be used. A Swiss-style machining approach may be used, in some embodiments. In particular, the tools may be held stationary, and the material can be moved about the spinning tool to form the fragmenting projectile 100. It should be understood that these examples are illustrative and therefore should not be construed as being limiting in any way.

The fragmenting projectile 100 can be formed from various metals or alloys. It has been discovered that different materials, different alloys, and/or even different specifications for a single material can provide different performance. In some embodiments, malleable materials may be used to provide a fragmenting projectile 100 that opens up upon impact, but does not shed its petals 108. Slight changes to powder charge can increase the speed of such a fragmenting projectile 100 and result in the petals 108 shedding or separating from the core 102, even with malleable materials.

According to various embodiments, the fragmenting projectile 100 can be formed from solid copper or solid copper alloys, though this is not necessarily the case, as various alloys and or composite materials can be used in accordance with the concepts and technologies described herein. In some embodiments, copper-based alloys can provide ease of manufacturing (e.g., machining characteristics may be ideal), as well as ductility and/or malleability. In some embodiments, the fragmenting projectile 100 is formed from a tellurium-copper (TelCu) alloy known as C145 (0.5% tellurium), which can support a dual behavior in solids and liquids/gels of the fragmenting projectile 100. In some other embodiments, the fragmenting projectile 100 is formed from a sulfur bearing copper alloy known as C147 (about 0.002-0.0005% Phosphorous, about 0.20-0.50% Sulfur, and remainder Copper), which can support the dual behavior in solids and liquids/gels of the fragmenting projectile 100.

In another embodiment, the fragmenting projectile 100 can be formed from an oxygen free copper alloy known as C101, which can support expansion of the petals 108 without readily supporting separation of the petals 108 because the material is more malleable than C145 or C147. As noted above, particular alloys can be specified to affect the performance of the fragmenting projectile 100, for example how far into the target the fragmenting projectile 100 penetrates into a particular medium prior to deployment and/or separation of the petals 108, as well as other aspects of the performance of the fragmenting projectile 100. As such, the fragmenting projectile 100 can be formed from various materials, and the above examples should be understood as being illustrative and therefore should not be construed as being limiting in any way.

According to various embodiments of the concepts and technologies described herein, the fragmenting projectile 100 is formed from C145 copper alloy, but a custom range of tensile strength is applied. In particular, according to various embodiments of the concepts and technologies described herein, the fragmenting projectile 100 can be formed from a C145 alloy that has a tensile strength within a range of 36-41 kilopounds per square inch (ksi), with an optimal tensile strength of 37.5 ksi. As is known, this tensile strength range exceeds the ASTM-B-301 standard for tensile strength range for C145. In some embodiments, the Applicant and/or some of the Applicant's suppliers may refer to a material that complies with this heightened standard for tensile strength as complying with the "G2 Specification" or the "G2 SPEC," though this is not necessarily the case. It should be understood that other copper alloys can be used, and that the above example embodiment is illustrative. As such, this embodiment should not be construed as being limiting in any way.

Various alloys can support different performance of the fragmenting projectile 100, as explained above. In particular, if the fragmenting projectile 100 is formed from a malleable material, the fragmenting projectile 100 may not lose its petals 108 as readily as a fragmenting projectile 100 with the same geometry that is formed from a material that is less malleable. As explained above, this may be desirable, in some instances, as the petals 108 of the fragmenting projectile 100 may open up without fragmenting from the core 102. In particular, the petals 108 may open to approximately 90-degrees and remain attached to the core 102. This embodiment can cause severe damage to the target while preventing penetration through the target and may be preferred in some instances.

In some other embodiments, the material for the fragmenting projectile 100 is selected to ensure that the petals 108 break off from the core 102 and therefore may be more brittle compared to the material used for an fragmenting projectile 100 in which separation of the petals 108 is not desired. Geometry of the fragmenting projectile 100 can affect separation (or a lack thereof) even more than material choice however.

In one contemplated embodiment, a hybrid fragmenting projectile 100 is provided by using a malleable material but making variations in the geometry to cause some petals 108 to open and to cause some other petals 108 to separate. Thus, for example, cuts may be made in the fragmenting projectile 100 near a midsection and may be alternated to every other petal base, internally or externally. In one embodiment, this process can result in a hybrid fragmenting projectile 100 that, upon impact, results in four petals 108 opening and remaining attached to the core 102, while four other petals (or other numbers of petals 108) split off the core 102 and expand outward. It should be understood that this example is illustrative and therefore should not be construed as being limiting in any way.

In some embodiments, the fragmenting projectile 100 can be formed with parallel grooves to reduce resistance in the bore. These grooves can create a collapsing point for the material to move into during the movement of the fragmenting projectile 100 through the barrel. This embodiment can allow for better bullet conformation to the barrel, in some embodiments. It should be understood that this example is illustrative and therefore should not be construed as being limiting in any way.

In some embodiments, non-continuous grooves or cuts can be cut or otherwise formed in a spiral on the fragmenting projectile 100 from the forward edge to a depth of about one half the length of the cavity, thereby leaving a small area of untouched material. The cuts or grooves can then continue to a point where material has been removed at the base of the petals 108 to create a hinge or weak point. The grooves or cuts may continue beyond the hinge point as this can affect the shape of the core 102 after the petals 108 have separated. This approach (forming grooves or cuts) in the fragmenting projectile 100 can be used to cause the petals 108 to remain attached to the core 102. It should be understood that the depth of the hinge cuts at the ends of the petals 108 can be another parameter that can affect performance of the fragmenting projectile 100. It should be understood that this example is illustrative and therefore should not be construed as being limiting in any way.

The concepts and technologies described herein can be applied to numerous calibers of projectiles, various masses or weights of projectiles, and/or various speeds of projectiles. In some embodiments, fragmenting projectiles 100 that exceed speeds of 1400 feet per second may not function as described herein, since high speeds may results in projectiles that pass through the target without expending the energy within the target, though this is not necessarily the case. In one test, a 9 mm fragmenting projectile 100 weighing 93 grains was produced. The fragmenting projectile 100 used in this test included a 50 grain core 102 and eight 5.4 grain petals 108. When fired into 10% ballistic gel at a velocity of 1,250 fps, the core 102 of the fragmenting projectile 100 penetrated 15.5 inches, and the petals 108 penetrated 6.5 inches with an expansion diameter of 7.5 inches. This observed penetration far exceeds the penetration expected for a round nose 93 grain 9 mm projectile fired at 1,250 fps. It should be understood that this example is illustrative and therefore should not be construed as being limiting in any way.

While the above description has made reference several times to rifling and/or rotation of the fragmenting projectile 100, it should be understood that various embodiments of the concepts and technologies described herein can be used with smooth bore firearms and/or other devices such as rail guns, or the like, that may not use rifling or otherwise induce rotation to the fragmenting projectile 100. Thus, for example, the concepts and technologies described herein can be used to create a fragmenting projectile 100 for use as a shotgun slug, a rail gun projectile, or the like. It should be understood that these examples are illustrative and therefore should not be construed as being limiting in any way.

Based on the foregoing, it should be appreciated that embodiments of a fragmenting projectile have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

The invention claimed is:

1. A fragmenting projectile comprising:
a substantially solid core of a material;
a plurality of petals attached to the core and formed from the material; and
a cavity bound by the core and inner surfaces of the plurality of petals, wherein the fragmenting projectile is configured to fragment by at least one of the plurality of petals pivoting outwardly and separating from the core.

2. The fragmenting projectile of claim 1, wherein the fragmenting projectile does not fragment when engaging wood, and wherein the fragmenting projectile fragments when engaging animal tissue or human tissue.

3. The fragmenting projectile of claim 1, wherein the fragmenting projectile does not fragment when engaging glass, and wherein the fragmenting projectile fragments when engaging animal tissue or human tissue.

4. The fragmenting projectile of claim 1, wherein the plurality of petals comprises eight petals.

5. The fragmenting projectile of claim 1, further comprising a plurality of channels that define the plurality of petals.

6. The fragmenting projectile of claim 5, further comprising a groove formed on the fragmenting projectile.

7. The fragmenting projectile of claim 1, wherein the material comprises a copper alloy having a tensile strength in a range of 36 kilopounds per square inch to 41 kilopounds per square inch.

8. The fragmenting projectile of claim 1, wherein the material comprises a tellurium-copper alloy having 0.5% tellurium, 99.5% copper, and a tensile strength of 37.5 kilopounds per square inch.

9. The fragmenting projectile of claim 1, further comprising break-off notches to encourage failure of the material at the break-off notches.

10. The fragmenting projectile of claim 1, further comprising a dimple formed in the material to encourage failure of the material at the dimple.

11. The fragmenting projectile of claim 10, wherein the dimple comprises a perforation that passes through the material to allow pressure in the cavity to escape through the plurality of petals.

12. The fragmenting projectile of claim 1, wherein the core comprises a point.

13. The fragmenting projectile of claim 1, wherein the fragmenting projectile is formed from a single piece of material.

14. A fragmenting projectile comprising:
a core of a material;
a plurality of petals attached to the core, the plurality of petals being formed from the material; and
a cavity bound by the core and inner surfaces of the plurality of petals, wherein the fragmenting projectile is configured to fragment by at least one of the plurality of petals pivoting outwardly and separating from the core.

15. The fragmenting projectile of claim 14, wherein the core comprises one third of a total mass of the fragmenting projectile, and wherein the plurality of petals comprise two thirds of the total mass of the fragmenting projectile.

16. The fragmenting projectile of claim 14, wherein the plurality of petals comprises eight petals, wherein the material comprises a copper alloy, and wherein the copper alloy has a tensile strength within a range of 36 kilopounds per square inch to 41 kilopounds per square inch.

17. The fragmenting projectile of claim 14, wherein the fragmenting projectile further comprises two grooves formed on the fragmenting projectile.

18. A fragmenting projectile comprising:

a core of a material;

a plurality of petals attached to the core and formed from the material, each of the plurality of petals comprising an outer surface and an inner surface; and a cavity bound by the core and the plurality of petals, wherein the cavity is defined by inner surfaces of the plurality of petals, wherein the fragmenting projectile is configured to fragment by at least one of the plurality of petals pivoting outwardly and separating from the core.

19. The fragmenting projectile of claim 18, wherein the plurality of petals comprises eight petals, wherein the material comprises a copper alloy, and wherein the copper alloy has a tensile strength within a range of 36 kilopounds per square inch to 41 kilopounds per square inch.

20. The fragmenting projectile of claim 18, wherein the fragmenting projectile further comprises two grooves formed on an outer surface of at least one of the petals.

* * * * *